US008870682B2

(12) United States Patent
Roach

(10) Patent No.: US 8,870,682 B2
(45) Date of Patent: Oct. 28, 2014

(54) MULTI-MATERIAL GOLF CLUB HEAD

(75) Inventor: Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 842 days.

(21) Appl. No.: 12/759,959

(22) Filed: Apr. 14, 2010

(65) Prior Publication Data

US 2010/0261540 A1 Oct. 14, 2010

Related U.S. Application Data

(63) Continuation-in-part of application No. 11/896,238, filed on Aug. 30, 2007, now Pat. No. 7,819,757, which is a continuation-in-part of application No. 11/822,197, filed on Jul. 3, 2007, now Pat. No. 7,922,604.

(60) Provisional application No. 60/832,228, filed on Jul. 21, 2006.

(51) Int. Cl.
*A63B 53/04* (2006.01)
*A63B 59/00* (2006.01)

(52) U.S. Cl.
CPC ..... *A63B 53/04* (2013.01); *A63B 59/0092* (2013.01); *A63B 2053/0416* (2013.01); *A63B 2053/0479* (2013.01); *A63B 2053/0491* (2013.01)
USPC ..... 473/349; 473/350

(58) Field of Classification Search
USPC ..... 473/324–350
See application file for complete search history.

(56) References Cited

U.S. PATENT DOCUMENTS

| | | | |
|---|---|---|---|
| 819,900 | A | 5/1906 | Martin |
| 1,319,233 | A | 10/1919 | Mattern |

(Continued)

FOREIGN PATENT DOCUMENTS

| | | |
|---|---|---|
| JP | 06-343722 | 12/1994 |
| JP | 07-031697 | 2/1995 |

(Continued)

OTHER PUBLICATIONS

Jackson, Jeff. The Modern Guide to Golf Clubmaking, Ohio: Dynacraft Golf Products, Inc. Copyright 1994, p. 237.*

(Continued)

*Primary Examiner* — Alvin Hunter
(74) *Attorney, Agent, or Firm* — Brown Rudnick LLP; Mark S. Leonardo

(57) ABSTRACT

A golf club head formed of multiple materials is disclosed. Those portions of the club head that are subject to high stresses during normal use of the golf club head are formed of a metallic material. Most of the material beyond what is required to maintain structural integrity, however, is removed and replaced with a lightweight material. This freed-up mass that can be redistributed to other, more beneficial locations of the club head. The lightweight material also damps vibrations generated during use of the golf club. This vibration damper may be retained in a state of compression to enhance the vibration damping. One or more weight members may be included to obtain desired center of gravity position, moments of inertia, and other club head attributes. An insert formed of multiple materials and having regions of varying thickness may also be included on a rear surface of the club head.

17 Claims, 17 Drawing Sheets

(56) References Cited

U.S. PATENT DOCUMENTS 1,534,600 A 4/1925 Mattern
2,429,351 A 10/1947 Fetterolf
2,686,056 A 8/1954 Oquist
3,084,940 A 4/1963 Cissel
3,695,618 A 10/1972 Woolley et al.
3,881,733 A 5/1975 Csernits
3,970,236 A 7/1976 Rogers
3,975,023 A 8/1976 Inamori
4,027,885 A 6/1977 Rogers
4,340,230 A 7/1982 Churchward
4,398,965 A 8/1983 Campau
4,523,759 A 6/1985 Igarashi
4,607,846 A 8/1986 Perkins
4,681,322 A 7/1987 Straza et al.
4,687,205 A 8/1987 Tominaga et al.
4,792,139 A 12/1988 Nagasaki et al.
4,811,950 A 3/1989 Kobayashi
4,874,171 A * 10/1989 Ezaki et al. ..... 473/290
4,884,812 A 12/1989 Nagasaki et al.
4,928,972 A 5/1990 Nakanishi et al.
4,957,294 A 9/1990 Long
4,964,640 A 10/1990 Nakanishi et al.
D321,920 S 11/1991 Parente et al.
5,104,457 A 4/1992 Viljoen et al.
5,106,094 A 4/1992 Desbiolles et al.
5,190,290 A 3/1993 Take
5,221,087 A 6/1993 Fenton et al.
D339,183 S 9/1993 Stites, III
5,242,167 A 9/1993 Antonious
D343,216 S 1/1994 Chorne
5,290,036 A 3/1994 Fenton et al.
5,299,807 A 4/1994 Hutin
5,303,922 A 4/1994 Lo
5,308,062 A * 5/1994 Hogan ..... 473/292
5,316,298 A 5/1994 Hutin et al.
5,377,979 A 1/1995 Long
5,377,985 A 1/1995 Ohnishi
5,398,929 A 3/1995 Kitaichi
5,403,007 A 4/1995 Chen
5,405,137 A 4/1995 Vincent et al.
5,409,229 A 4/1995 Schmidt et al.
5,413,336 A 5/1995 Iwanaga
5,431,396 A 7/1995 Shieh
5,433,440 A 7/1995 Lin
5,492,327 A 2/1996 Biafore
5,544,885 A 8/1996 Besnard et al.
5,564,705 A 10/1996 Kobayashi et al.
5,586,947 A 12/1996 Hutin
5,586,948 A 12/1996 Mick
5,588,923 A 12/1996 Schmidt et al.
5,605,511 A 2/1997 Schmidt et al.
5,616,088 A 4/1997 Aizawa et al.
5,626,530 A 5/1997 Schmidt et al.
5,643,111 A * 7/1997 Igarashi ..... 473/332
5,643,112 A 7/1997 Basnard et al.
5,658,208 A * 8/1997 Shimasaki ..... 473/349
5,669,826 A 9/1997 Chang et al.
5,669,829 A 9/1997 Lin
5,683,310 A 11/1997 Chen
5,697,855 A 12/1997 Aizawa
5,704,849 A 1/1998 Schmidt et al.
5,713,800 A 2/1998 Su
5,720,673 A 2/1998 Anderson
5,749,794 A * 5/1998 Kobayashi et al. ..... 473/342
5,766,092 A 6/1998 Mimeur et al.
5,772,527 A 6/1998 Liu
5,776,010 A 7/1998 Helmstetter et al.
5,833,551 A 11/1998 Vincent et al.
5,863,261 A 1/1999 Eggiman
5,890,973 A 4/1999 Gamble
5,924,939 A 7/1999 Grace et al.
5,944,619 A 8/1999 Cameron
5,967,903 A 10/1999 Cheng
5,993,329 A 11/1999 Shieh
6,001,030 A 12/1999 Delaney
6,042,486 A 3/2000 Gallagher
6,045,456 A * 4/2000 Best et al. ..... 473/291
6,080,069 A 6/2000 Long
6,089,992 A 7/2000 Onuki et al.
6,095,931 A 8/2000 Hettinger et al.
6,102,812 A * 8/2000 Takeda ..... 473/291
RE36,950 E 11/2000 Allen
6,179,726 B1 * 1/2001 Satoh et al. ..... 473/290
6,183,376 B1 2/2001 Peters et al.
6,217,460 B1 4/2001 Broadbridge et al.
6,231,458 B1 5/2001 Cameron et al.
6,254,494 B1 * 7/2001 Hasebe et al. ..... 473/349
6,267,691 B1 7/2001 Dammen
6,306,048 B1 10/2001 McCabe et al.
6,319,149 B1 11/2001 Lee
6,319,150 B1 11/2001 Werner et al.
6,334,818 B1 1/2002 Cameron et al.
6,338,683 B1 1/2002 Kosmatka
6,354,962 B1 3/2002 Galloway et al.
6,358,158 B2 3/2002 Peters et al.
6,364,789 B1 4/2002 Kosmatka
6,379,262 B1 4/2002 Boone
6,381,828 B1 5/2002 Boyce et al.
6,390,933 B1 5/2002 Galloway et al.
6,398,666 B1 6/2002 Evans et al.
6,428,426 B1 8/2002 Helmstetter et al.
6,428,427 B1 8/2002 Kosmatka
6,440,010 B1 8/2002 Deshmukh
6,443,857 B1 9/2002 Chuang
6,471,604 B2 10/2002 Hocknell et al.
6,478,690 B2 11/2002 Helmstetter et al.
6,482,104 B1 * 11/2002 Gilbert ..... 473/287
6,491,592 B2 12/2002 Cackett et al.
6,491,593 B2 12/2002 Takeda
6,524,196 B1 2/2003 Yeh
6,530,846 B1 * 3/2003 Mase ..... 473/290
6,554,722 B2 4/2003 Erickson et al.
6,558,272 B2 5/2003 Helmstetter et al.
6,565,452 B2 5/2003 Helmstetter et al.
6,569,033 B2 5/2003 Kosmatka
6,582,321 B2 6/2003 Galloway et al.
6,582,323 B2 6/2003 Soracco et al.
6,592,468 B2 7/2003 Vincent et al.
6,592,469 B2 * 7/2003 Gilbert ..... 473/350
6,602,150 B1 8/2003 Kosmatka
6,605,007 B1 8/2003 Bissonnette et al.
6,616,547 B2 9/2003 Vincent et al.
6,623,377 B2 9/2003 Evans et al.
6,638,183 B2 10/2003 Takeda
6,659,885 B1 12/2003 Knuth
6,663,504 B2 12/2003 Helmstetter et al.
6,688,989 B2 2/2004 Best
6,709,345 B2 3/2004 Iwata et al.
6,719,641 B2 4/2004 Dabbs et al.
6,739,983 B2 5/2004 Helmstetter et al.
6,743,114 B2 6/2004 Best
6,743,117 B2 6/2004 Gilbert
6,769,998 B2 8/2004 Clausen et al.
6,773,361 B1 8/2004 Lee
6,811,496 B2 11/2004 Wahl et al.
6,824,475 B2 11/2004 Burnett et al.
6,835,144 B2 12/2004 Best
6,849,005 B2 2/2005 Rife
6,855,066 B2 2/2005 Best
6,857,973 B2 2/2005 Wieland et al.
6,860,822 B2 3/2005 Vrska
6,863,626 B2 3/2005 Evans et al.
6,872,153 B2 3/2005 Gilbert et al.
6,875,124 B2 4/2005 Gilbert et al.
6,887,164 B2 5/2005 Dewanjee et al.
6,899,638 B2 5/2005 Iwata et al.
6,902,495 B2 6/2005 Pergande
6,918,840 B2 7/2005 Stites et al.
6,921,344 B2 7/2005 Gilbert et al.
6,923,732 B2 8/2005 Stites et al.
6,929,563 B2 8/2005 Nishitani
6,932,717 B2 * 8/2005 Hou et al. ..... 473/332
6,960,142 B2 11/2005 Bissonnette et al.
6,964,620 B2 11/2005 Gilbert et al.

(56) References Cited

U.S. PATENT DOCUMENTS

| | | | | |
|---|---|---|---|---|
| 6,966,848 | B2 | 11/2005 | Kusumoto | |
| 6,976,924 | B2 * | 12/2005 | Gilbert et al. | 473/332 |
| 6,984,180 | B2 * | 1/2006 | Hasebe | 473/291 |
| 6,991,559 | B2 | 1/2006 | Yabu | |
| 6,997,820 | B2 | 2/2006 | Willett et al. | |
| 7,008,331 | B2 | 3/2006 | Chen | |
| 7,014,570 | B2 | 3/2006 | Evans et al. | |
| 7,018,305 | B2 | 3/2006 | Sugimoto | |
| 7,025,693 | B2 | 4/2006 | Sugimoto | |
| 7,029,403 | B2 | 4/2006 | Rice et al. | |
| 7,041,003 | B2 | 5/2006 | Bissonnette et al. | |
| 7,048,648 | B2 | 5/2006 | Breier et al. | |
| 7,070,513 | B2 | 7/2006 | Takeda et al. | |
| 7,086,962 | B2 | 8/2006 | Galloway et al. | |
| 7,097,572 | B2 | 8/2006 | Yabu | |
| 7,126,339 | B2 | 10/2006 | Nagai et al. | |
| 7,144,337 | B2 | 12/2006 | Hirano | |
| 7,147,575 | B2 | 12/2006 | Galloway et al. | |
| 7,153,219 | B2 | 12/2006 | Reed et al. | |
| 7,160,204 | B2 | 1/2007 | Huang | |
| 7,169,059 | B2 | 1/2007 | Rice et al. | |
| 7,182,698 | B2 | 2/2007 | Tseng | |
| 7,186,188 | B2 | 3/2007 | Gilbert et al. | |
| 7,192,362 | B2 | 3/2007 | Gilbert et al. | |
| 7,192,364 | B2 | 3/2007 | Long | |
| 7,207,898 | B2 | 4/2007 | Rice et al. | |
| 7,207,899 | B2 | 4/2007 | Imamoto | |
| 7,207,900 | B2 | 4/2007 | Nicolette et al. | |
| 7,214,142 | B2 | 5/2007 | Meyer et al. | |
| 7,220,189 | B2 | 5/2007 | Wieland et al. | |
| 7,220,190 | B2 | 5/2007 | Hirano | |
| 7,232,380 | B2 * | 6/2007 | Nakahara | 473/324 |
| 7,238,119 | B2 | 7/2007 | Roach et al. | |
| 7,244,188 | B2 * | 7/2007 | Best | 473/291 |
| 7,258,626 | B2 | 8/2007 | Gibbs et al. | |
| 7,261,643 | B2 | 8/2007 | Rice et al. | |
| 7,273,421 | B2 | 9/2007 | Knuth | |
| 7,278,925 | B2 | 10/2007 | Oyama | |
| 7,326,127 | B2 * | 2/2008 | Hou et al. | 473/326 |
| 7,338,387 | B2 | 3/2008 | Nycum et al. | |
| 7,338,388 | B2 | 3/2008 | Schweigert et al. | |
| 7,347,794 | B2 | 3/2008 | Schweigert | |
| 7,361,099 | B2 | 4/2008 | Rice et al. | |
| 7,367,899 | B2 | 5/2008 | Rice et al. | |
| 7,384,348 | B2 | 6/2008 | Lin et al. | |
| 7,387,579 | B2 | 6/2008 | Lin et al. | |
| 7,422,527 | B2 | 9/2008 | Rice et al. | |
| 7,422,528 | B2 | 9/2008 | Gibbs et al. | |
| 7,435,189 | B2 | 10/2008 | Hirano | |
| 7,448,960 | B2 | 11/2008 | Gibbs et al. | |
| 7,473,190 | B2 | 1/2009 | Hocknell et al. | |
| 7,476,162 | B2 | 1/2009 | Stites et al. | |
| 7,481,717 | B2 | 1/2009 | Knuth | |
| 7,481,719 | B2 | 1/2009 | Imamoto | |
| 7,556,572 | B2 | 7/2009 | Stites et al. | |
| 7,588,503 | B2 | 9/2009 | Roach et al. | |
| 7,597,633 | B2 | 10/2009 | Shimazaki et al. | |
| 7,614,962 | B1 | 11/2009 | Clausen | |
| 7,654,914 | B2 | 2/2010 | Roach et al. | |
| 7,662,050 | B2 | 2/2010 | Gilbert et al. | |
| 7,713,141 | B2 | 5/2010 | Yamamoto | |
| 7,753,808 | B2 | 7/2010 | Matsunaga | |
| 7,819,757 | B2 * | 10/2010 | Soracco et al. | 473/332 |
| 7,833,110 | B2 * | 11/2010 | Nakamura | 473/332 |
| 7,871,338 | B2 | 1/2011 | Nakano | |
| 7,914,395 | B2 | 3/2011 | Stites et al. | |
| 7,922,604 | B2 * | 4/2011 | Roach et al. | 473/350 |
| 7,997,999 | B2 * | 8/2011 | Roach et al. | 473/332 |
| 8,221,263 | B2 * | 7/2012 | Tavares et al. | 473/332 |
| 2002/0042307 | A1 | 4/2002 | Deshmukh | |
| 2002/0094883 | A1 | 7/2002 | Chuang | |
| 2002/0165041 | A1 | 11/2002 | Takeda | |
| 2003/0013543 | A1 | 1/2003 | Helmstetter et al. | |
| 2003/0022729 | A1 | 1/2003 | Pergande et al. | |
| 2003/0032499 | A1 | 2/2003 | Wahl et al. | |
| 2003/0045372 | A1 | 3/2003 | Vrska | |
| 2003/0092502 | A1 | 5/2003 | Pergande et al. | |
| 2003/0125129 | A1 | 7/2003 | Saksun | |
| 2003/0139225 | A1 | 7/2003 | Rife | |
| 2003/0195058 | A1 | 10/2003 | Rice et al. | |
| 2003/0199334 | A1 | 10/2003 | Bissonnette et al. | |
| 2003/0199335 | A1 | 10/2003 | Bissonnette et al. | |
| 2003/0220157 | A1 | 11/2003 | Dennis et al. | |
| 2003/0228928 | A1 | 12/2003 | Yabu | |
| 2004/0023730 | A1 | 2/2004 | Nagai et al. | |
| 2004/0043830 | A1 | 3/2004 | Imamoto | |
| 2004/0082405 | A1 | 4/2004 | Sano | |
| 2004/0116200 | A1 | 6/2004 | Helmstetter et al. | |
| 2004/0242339 | A1 | 12/2004 | Gilbert et al. | |
| 2005/0096150 | A1 | 5/2005 | Hou et al. | |
| 2005/0096151 | A1 | 5/2005 | Hou et al. | |
| 2005/0101407 | A1 | 5/2005 | Hirano | |
| 2005/0137029 | A1 | 6/2005 | Evans et al. | |
| 2005/0209019 | A1 | 9/2005 | Schweigert | |
| 2005/0239572 | A1 | 10/2005 | Roach et al. | |
| 2005/0272524 | A1 | 12/2005 | Oh | |
| 2005/0277484 | A1 | 12/2005 | Reed et al. | |
| 2006/0025234 | A1 | 2/2006 | Nicolette et al. | |
| 2006/0025235 | A1 | 2/2006 | Nakahara et al. | |
| 2006/0046868 | A1 | 3/2006 | Murphy | |
| 2006/0111198 | A1 | 5/2006 | Matsunaga | |
| 2006/0194641 | A1 | 8/2006 | Best | |
| 2007/0049415 | A1 | 3/2007 | Shear | |
| 2007/0066420 | A1 | 3/2007 | Imamoto et al. | |
| 2007/0281796 | A1 | 12/2007 | Gilbert et al. | |
| 2008/0020860 | A1 | 1/2008 | Imamoto | |
| 2008/0058119 | A1 | 3/2008 | Soracco et al. | |
| 2009/0118037 | A1 | 5/2009 | Roach et al. | |
| 2011/0143857 | A1 | 6/2011 | Roach | |

FOREIGN PATENT DOCUMENTS

| | | | | | |
|---|---|---|---|---|---|
| JP | 07155410 | A | * | 6/1995 | A63B 53/04 |
| JP | 07275412 | A | * | 10/1995 | A63B 53/04 |
| JP | 08-164229 | | | 6/1996 | |
| JP | 08-257171 | | | 10/1996 | |
| JP | 3032837 | | | 10/1996 | |
| JP | 09-000666 | | | 1/1997 | |
| JP | 09-066125 | | | 3/1997 | |
| JP | 09-117537 | | | 5/1997 | |
| JP | 09154986 | A | * | 6/1997 | A63B 53/04 |
| JP | 09-173513 | | | 7/1997 | |
| JP | 09-215795 | | | 8/1997 | |
| JP | 09-215796 | | | 8/1997 | |
| JP | 09-225075 | | | 9/1997 | |
| JP | 09-239075 | | | 9/1997 | |
| JP | 09225077 | A | * | 9/1997 | A63B 53/04 |
| JP | 09-276455 | | | 10/1997 | |
| JP | 09-299519 | | | 11/1997 | |
| JP | 09-322952 | | | 12/1997 | |
| JP | 10151231 | A | * | 6/1998 | A63B 53/04 |
| JP | 10-234897 | | | 9/1998 | |
| JP | 10-314349 | | | 12/1998 | |
| JP | 11057085 | A | * | 3/1999 | A63B 53/04 |
| JP | 11-114109 | | | 4/1999 | |
| JP | 11-128412 | | | 5/1999 | |
| JP | 11-161863 | | | 6/1999 | |
| JP | 11-169493 | | | 6/1999 | |
| JP | 11-299938 | | | 11/1999 | |
| JP | 11-299939 | | | 11/1999 | |
| JP | 11-299940 | | | 11/1999 | |
| JP | 11-313906 | | | 11/1999 | |
| JP | 2000126339 | A | * | 5/2000 | A63B 53/04 |
| JP | 2000-197718 | | | 7/2000 | |
| JP | 2000-296192 | | | 10/2000 | |
| JP | 2001-029521 | | | 2/2001 | |
| JP | 2001-058015 | | | 3/2001 | |
| JP | 2001-137396 | | | 5/2001 | |
| JP | 2001-161868 | | | 6/2001 | |
| JP | 2001-190720 | | | 7/2001 | |
| JP | 2001212270 | A | * | 8/2001 | A63B 53/04 |
| JP | 2001-346918 | | | 12/2001 | |
| JP | 2002-102396 | | | 4/2002 | |
| JP | 2002-165903 | | | 6/2002 | |

(56) References Cited

FOREIGN PATENT DOCUMENTS

| | | | | | |
|---|---|---|---|---|---|
| JP | 2002-172187 | | | 6/2002 | |
| JP | 2002-186692 | | | 7/2002 | |
| JP | 2002-191726 | | | 7/2002 | |
| JP | 2002-191730 | | | 7/2002 | |
| JP | 2002-233596 | | | 8/2002 | |
| JP | 2002-239037 | | | 8/2002 | |
| JP | 2002-315854 | | | 10/2002 | |
| JP | 2002-360747 | | | 12/2002 | |
| JP | 2003-339921 | | | 2/2003 | |
| JP | 2003-062134 | | | 3/2003 | |
| JP | 2003-117032 | | | 4/2003 | |
| JP | 2003-135630 | | | 5/2003 | |
| JP | 2003-154040 | | | 5/2003 | |
| JP | 2003-236021 | | | 8/2003 | |
| JP | 2004-135963 | | | 5/2004 | |
| JP | 2004-202044 | | | 7/2004 | |
| JP | 2004-261450 | | | 9/2004 | |
| JP | 2004-329544 | | | 11/2004 | |
| JP | 2005-052272 | | | 3/2005 | |
| JP | 2005-143591 | | | 9/2005 | |
| JP | 2005-305115 | | | 11/2005 | |
| JP | 2006-000554 | | | 1/2006 | |
| JP | 2006-043460 | | | 2/2006 | |
| JP | 2006-043461 | | | 2/2006 | |
| JP | 2006-087928 | | | 4/2006 | |
| JP | 2006-129936 | | | 5/2006 | |
| JP | 2007-029710 | | | 2/2007 | |
| JP | 2007-117743 | | | 5/2007 | |
| JP | 2007-125399 | | | 5/2007 | |
| JP | 2007-229487 | | | 9/2007 | |
| JP | 2007260316 | A | * | 10/2007 | |
| JP | 2007275231 | A | * | 10/2007 | |
| JP | 2008-023348 | | | 2/2008 | |
| JP | 2008-100056 | | | 5/2008 | |
| JP | 2010273804 | A | * | 12/2010 | |
| JP | 2011004810 | A | * | 1/2011 | |
| JP | 2011-115607 | | | 6/2011 | |
| WO | WO 99/20358 | | | 4/1999 | |
| WO | WO 9920358 | A1 | * | 4/1999 | ..... A63B 53/04 |

OTHER PUBLICATIONS

Japanese Office Action dated Sep. 28, 2010 (mailed Oct. 19, 2010) in Application No. 2007-212484.

U. S. Office Action dated Oct. 21, 2009 in U.S. Appl. No. 11/822,197.

U. S. Office Action dated Apr. 12, 2010 in U.S. Appl. No. 11/822,197.

U. S. Office Action, Notice of Allowance dated Dec. 2, 2010 in U.S. Appl. No. 11/822,197.

U. S. Office Action dated Dec. 30, 2009 in U.S. Appl. No. 11/896,238.

U. S. Office Action dated Mar. 19, 2010 in U.S. Appl. No. 11/896,238.

U. S. Office Action dated Mar. 6, 2009 in U.S. Appl. No. 11/896,238.

* cited by examiner

MULTI-MATERIAL GOLF CLUB HEAD

CROSS-REFERENCE TO RELATED APPLICATIONS

This is a continuation-in-part of U.S. patent application Ser. No. 11/896,238 filed on Aug. 30, 2007, now pending, which is a continuation-in-part of U.S. patent application Ser. No. 11/822,197 filed on Jul. 3, 2007, now pending, which claims the benefit of U.S. Provisional Patent Application No. 60/832,228 filed on Jul. 21, 2006, which are incorporated herein by reference their entireties.

FIELD OF THE INVENTION

The present invention relates to a golf club, and, more particularly, the present invention relates to a golf club head having a multi-material construction.

BACKGROUND OF THE INVENTION

Golf club heads come in many different forms and makes, such as wood- or metal-type, iron-type (including wedge-type club heads), utility- or specialty-type, and putter-type. Each of these styles has a prescribed function and make-up. The present invention will be discussed as relating to iron-type clubs, but the inventive teachings disclosed herein may be applied to other types of clubs.

Iron-type and utility-type golf club heads generally include a front or striking face, a hosel, and a sole. The front face interfaces with and strikes the golf ball. A plurality of grooves, sometimes referred to as "score lines," is provided on the face to assist in imparting spin to the ball. The hosel is generally configured to have a particular look to the golfer, to provide a lodging for the golf shaft, and to provide structural rigidity for the club head. The sole of the golf club is particularly important to the golf shot because it contacts and interacts with the playing surface during the swing.

In conventional sets of iron-type golf clubs, each club includes a shaft with a club head attached to one end and a grip attached to the other end. The club head includes a face for striking a golf ball. The angle between the face and a vertical plane is called the loft angle. The set generally includes irons that are designated number 3 through number 9, and a pitching wedge. One or more additional long irons, such as those designated number 1 or number 2, and wedges, such as a gap wedge, a sand wedge, and a lob wedge, may optionally be included with the set. Alternatively, the set may include irons that are designated number 4 through number 9, a pitching wedge, and a gap wedge. Each iron has a shaft length that usually decreases through the set as the loft for each club head increases from the long irons to the short irons. The overall weight of each club head increases through the set as the shaft length decreases from the long irons to the short irons. To properly ensure that each club has a similar feel or balance during a golf swing, a measurement known as "swingweight" is often used as a criterion to define the club head weight and the shaft length. Because each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle and an increase in club length. However, difficulty of use also increases with a decrease in loft angle and an increase in club length.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Because blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia, which is a measurement of the club's resistance to torque, for example the torque resulting from an off-center hit. This produces a more forgiving club with a larger sweet spot. Having a larger sweet spot increases the ease of use. The decrease in club head mass resulting from the cavity also allows the size of the club face to be increased, further enlarging the sweet spot. These clubs are easier to hit than blades and muscle backs, and are therefore more readily usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location.

SUMMARY OF THE INVENTION

The present invention relates to a golf club. In particular, the present invention relates to a golf club head having a multi-material construction. In one embodiment, the golf club head comprises a first body portion including at least a part of a sole of the club head. The first body portion is made of a first material having a first density. A second body portion may be coupled to a rear surface of the first body portion opposite the face. The second body portion comprises a second material having a second density. A third body portion may be coupled to at least one of the first and second body portions. The third body portion comprises a third material having a third density. In one embodiment, the third density is greater than the first density, and the first density is greater than the second density. According to one aspect of the invention, the loft of the club head may be between about 25° and about 32°.

A face insert may be coupled to the first body portion. The face insert may be made of titanium, a titanium alloy, a high strength steel, a high strength aluminum alloy, or a metal matrix composite material.

According to one aspect of the invention, the rotational moment of inertia about a vertical axis of the club head is greater than about 2800 g·cm$^2$. In one embodiment, the rotational moment of inertia about a vertical axis is greater than about 3000 g·cm$^2$. The club head may satisfy the following relationship:

$$I_{ZZ} \geq CG_Z * 170$$

where $I_{ZZ}$ is the rotational moment of inertia about a vertical axis and has units of g·cm$^2$ and $CG_Z$ is the vertical center of gravity and has units of mm.

In one embodiment, the density of the third material is greater than about 10 g/cm$^3$. The third body portion may comprise greater than about 10% of the total mass of the club head. In addition, $CG_Z$ may be less than 17 mm. The club head may satisfy the following relationship:

$$I_{ZZ} \geq CG_Z * D * 17$$

where $I_{ZZ}$ is the rotational moment of inertia about a vertical axis and has units of g·cm$^2$ and $CG_Z$ is the vertical center of gravity and has units of mm, and wherein D is the third density.

In one embodiment, the vertical center of gravity of the club head may be greater than about 17 mm. In addition, the second material may have a density less than about 3 g/cm$^3$. The club head may satisfy the relationship:

$$I_{ZZ} \geq CG_Z * D * 123$$

where $I_{ZZ}$ is the rotational moment of inertia about a vertical axis and has units of g·cm$^2$ and $CG_Z$ is the vertical center of gravity and has units of mm, and wherein D is the density of the second material.

The present invention is also directed toward a golf club head comprising a body defining a front opening with a ledge adjacent the front opening. A face insert may be coupled to the body at the ledge. The face insert may comprise titanium, a titanium alloy, a high strength steel, a high strength aluminum alloy, or a metal matrix composite material. In addition, a damping member may be intermediate the body and the face insert. The damping member may comprise bulk molding compound, rubber, urethane, polyurethane, a viscoelastic material, a thermoplastic or thermoset polymer, butadiene, polybutadiene, silicone, or combinations thereof.

According to one aspect of the invention, the rotational moment of inertia about a vertical axis may be greater than about 2800 g·cm$^2$. The club head may satisfy the relationship:

$$I_{ZZ} \geq CG_Z * 170.$$

where $I_{ZZ}$ is the rotational moment of inertia about a vertical axis and has units of g·cm$^2$ and $CG_Z$ is the vertical center of gravity and has units of mm.

The present invention is also directed to a set of iron type golf clubs. The set may include a golf club head having a first body portion including at least a part of a sole. The first body portion is made of a first material having a first density. A second body portion may be coupled to a rear surface of the first body portion opposite the face. The second body portion comprises a second material having a second density. A third body portion may be coupled to at least one of the first and second body portions. The third body portion comprises a third material having a third density. In one embodiment, the third density is greater than the first density, and the first density is greater than the second density. According to one aspect of the invention, at least one club head of the set may have a loft be between about 25° and about 32°. A face insert may be coupled to the first body portion. The face insert may be made of titanium, a titanium alloy, a high strength steel, a high strength aluminum alloy, or a metal matrix composite material. According to one aspect of the invention, the rotational moment of inertia about a vertical axis of each club head in the set is greater than about 2800 g·cm$^2$.

In one embodiment, the set of clubs includes at least one club head having a vertical center of gravity less than 17 mm. In another embodiment, the set of clubs includes at least one club head having a vertical center of gravity greater than 17 mm.

In one embodiment, at least one club of the set satisfies the relationship:

$$I_{ZZ} \geq CG_Z * 170$$

where $I_{ZZ}$ is the rotational moment of inertia about a vertical axis and has units of g·cm$^2$ and $CG_Z$ is the vertical center of gravity and has units of mm.

In another embodiment, at least one club of the set satisfies the relationship:

$$I_{ZZ} \geq CG_Z * D * 17$$

where $I_{ZZ}$ is the rotational moment of inertia about a vertical axis and has units of g·cm$^2$ and $CG_Z$ is the vertical center of gravity and has units of mm, and wherein D is the third density.

According to another aspect of the invention, at least one club of the set satisfies the relationship:

$$I_{ZZ} \geq CG_Z * D * 123$$

where $I_{ZZ}$ is the rotational moment of inertia about a vertical axis and has units of g·cm$^2$ and $CG_Z$ is the vertical center of gravity and has units of mm, and wherein D is the density of the second material.

Traditionally, all or a large portion of the club head body is made of a metallic material. While it is beneficial to form some parts of the club head, such as the striking face, hosel, and sole, from a metallic material, it is not necessarily beneficial to form other parts of the club head from the same material. Most of the material beyond what is required to maintain structural integrity can be considered parasitic when it comes to designing a more forgiving golf club. The present invention provides an improved golf club by removing this excess or superfluous material and redistributing it elsewhere such that it may do one or more of the following: increase the overall size of the club head, optimize the club head center of gravity, produce a greater club head moment of inertia, and/or expand the size of the club head sweet spot.

A golf club head of the present invention includes a body defining a striking face, a top line, a sole, a back, a heel, a toe, and a hosel. The body is formed of multiple parts. A first body part includes the face, the hosel, and at least a portion of the sole. This first body portion is formed of a metallic material such that it can resist the forces imposed upon it through impact with a golf ball or the golfing surface, and other forces normally incurred through use of a golf club. The striking face of first body part, however, is thinner than conventional golf club heads, while still maintaining sufficient structural integrity, such that mass (and weight) is "freed up" to be redistributed to other, more beneficial locations of the club head.

This golf club head further includes a second body part that is made of a lightweight material, such that it provides for a traditional or otherwise desired appearance without imparting significant weight to the club head. Additionally, the second body part acts as a damping member, which can dissipate unwanted vibrations generated during use of the golf club. The second body part may form part of the club head sole. This second body part also acts as a spacer, allowing the inclusion of one or more dense third body parts. These third body parts can be positioned as desired to obtain beneficial attributes and playing characteristics. Exemplary positions for the third body parts (which may be considered weight members) include low and rear portions of the club head. The club head designer can thus manipulate the center of gravity position, moment of inertia, and other club head attributes.

The face of the club head may be unitary with the first body part, or it may be a separate insert that is joined to the club head body. Providing the face as a separate part allows the designer more freedom in selecting the material of the ball striking face, which may be different than the rest of the club head body. Use of a face insert also allows for the use of a damping member that is retained in a state of compression, which further enhances vibration damping. According to another inventive aspect, a multi-material insert assembly is attached to the rear surface of the golf club head, opposite the striking face. This insert assembly has varying rearward thickness. A relatively thick region of the insert assembly is positioned opposite the hitting region of the striking face, the area intended to impact a golf ball during a golf swing. A region of intermediate thickness is positioned to surround an area opposite the hitting region of the face. Finally, a relatively thin region is positioned towards the top of the club head rear surface.

This insert assembly may include a first component formed of a material that damps or dissipates vibrations, such as those imparted by striking a golf during a typical golf swing. This component accounts for the varying thickness of the insert assembly, with the thickest portion of the damping material component being positioned opposite the portion of the strike face intended to impact the golf ball. The region of intermediate thickness surrounds the thick region, thereby being opposite the perimeter of the hitting region of the striking face.

The insert assembly also contains a second component that is made of a material that is more rigid than the first insert assembly component. This second component overlies the first component and is rearwardly exposed. Thus, the first insert assembly component is positioned intermediate the golf club body and the second insert assembly component. The second component may beneficially include apertures through which a portion of the first insert assembly, such as the region of intermediate thickness, extends. In this manner, the insert assembly functions as both a constrained-layer damper where the second component overlies and contacts the first component, and a free-layer damper where the first component extends through the apertures and is rearwardly exposed.

Other features, such as an undercut body and a ledge to which the face insert is attached, may also beneficially be included with the inventive club head.

BRIEF DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertia, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
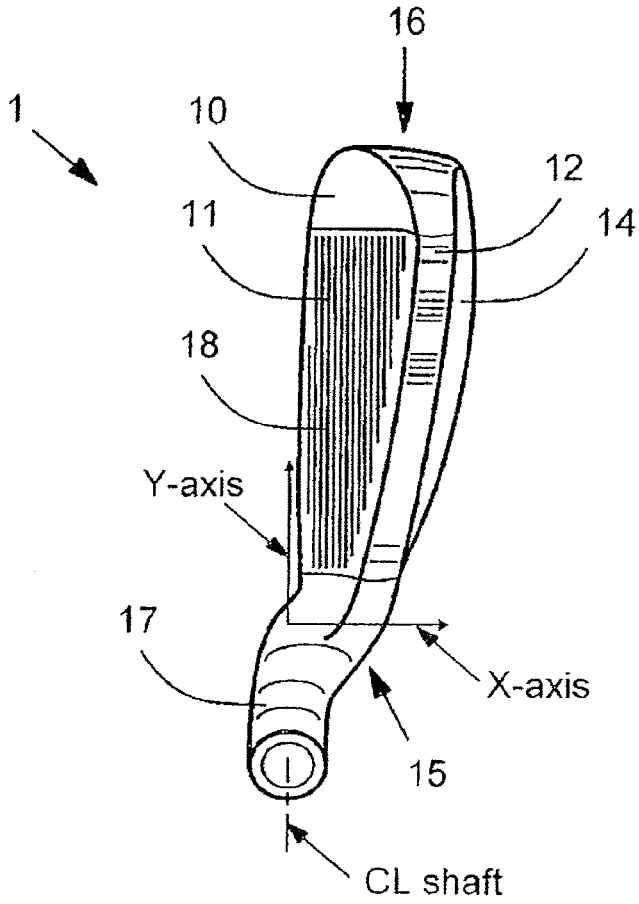
FIG. 1 is a top view of a golf club head of the present invention.
Figure 2:
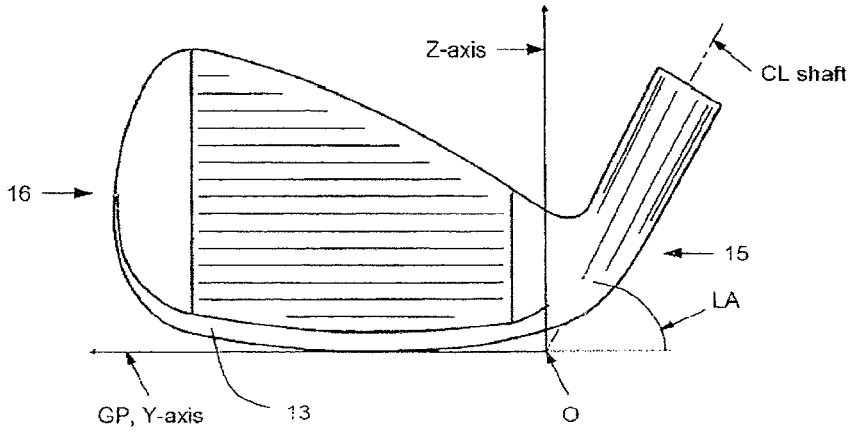
FIG. 2 is a front view of the golf club head of FIG. 1.

FIG. 1 is a top view of a golf club head 1 of the present invention, and FIG. 2 is a front view of the golf club head 1. The golf club head 1 includes a body 10, a front surface 11, a top line 12, a sole 13, a back 14, a heel 15, a toe 16, and a hosel 17. The striking face of the front surface 11 preferably contains grooves 18 therein. Various portions of the club head 1, such as the sole 13, may be unitary with the body 10 or may be separate bodies, such as inserts, coupled thereto. While the club head 1 is illustrated as an iron-type golf club head, the present invention may also pertain to other types of club heads, such as utility-type golf club heads or putter-type club heads.

FIGS. 1 and 2 define a convenient coordinate system to assist in understanding the orientation of the golf club head 1 and other terms discussed herein. An origin O is located at the intersection of the shaft centerline CLSH and the ground plane GP, which is defined at a predetermined angle from the shaft centerline CLSH, referred to as the lie angle LA, and tangent to the sole 13 at its lowest point. An X-axis is defined as a vector that is opposite in direction of the vector that is normal to the face 11 projected onto the ground plane GP. A Y-axis is defined as vector perpendicular to the X-axis and directed toward the toe 16. A Z-axis is defined as the cross product of the X-axis and the Y-axis.

Figure 3:
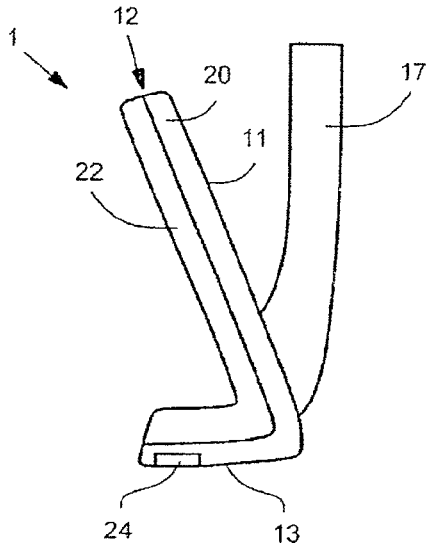
FIG. 3 is a cross-sectional view of a golf club head of the present invention.

As shown in FIG. 3, which illustrates a cross-sectional view of a golf club head 1 of the present invention, the club head 1 may comprise two main portions: a first body portion 20 and a second body portion 22. Optionally, a third body portion 24 may be included. The first body portion 20 preferably includes the hosel 17, the face 11, and at least a portion of the sole 13, and is formed of a material that is able to withstand forces imposed upon it during normal use of the golf club. Such forces may include those resulting from striking the golf ball and the playing surface. Similarly, the material should allow the lie angle, loft angle, and/or other club head attributes to be adjusted, such as by bending of the hosel 17. Preferred materials for the first body part 20 include ferrous alloy, titanium, titanium alloy, steel, and other metallic materials. This portion of the club head 1 may be formed by forging or casting as a single piece. Alternatively, this portion of the club head 1 may be formed by combining two or more separate pieces. For example, the face 11 may be a face insert that is coupled to a peripheral opening in the remaining portion of the first body portion 20.

The second body portion 22 is coupled to a rear surface of the first body portion 20, preferably opposite the face 11, and forms a middle portion of the club head 1. This portion of the club head 1 preferably is formed of a lightweight material. Thus, this portion of the club head 1 does not have a significant effect on the physical characteristics of the club head 1. Preferred materials for the second body part 22 include a bulk molding compound, rubber, urethane, polyurethane, a viscoelastic material, a thermoplastic or thermoset polymer, butadiene, polybutadiene, silicone, and combinations thereof. Through the use of these materials, the second body portion 22 may also function as a damper to diminish vibrations in the club head 1, including vibrations generated during an off-center hit.

According to one aspect of the invention, the second body portion 22 may have a density from approximately 0.5 g/cm$^3$ to approximately 5 g/cm$^3$, and is preferably less than the density of first body portion 20 by at least about 3 g/cm$^3$. For example, second body portion 22 may have a density between about 1.2 g/cm$^3$ to about 2 g/cm$^3$. Preferably, the density of second body portion 22 in this embodiment is less than 1.5 g/cm$^3$. Ideally, the density of second body portion 22 in this embodiment is less than 1.3 g/cm$^3$. In one embodiment, the density of second body portion 22 is less than the density of first body portion 20 by at least about 3 g/cm$^3$. In another embodiment, the density of the second body portion 22 is less than the density of first body portion 20 by at least about 4 g/cm$^3$.

The third body portion 24 is coupled to at least one of the first and second body portions 20, 22. The third body portion 24 may be a single piece, or it may be provided as a plurality of separate pieces that are attached to the first and/or second body portions 20, 22. The third body portion 24 preferably is positioned in the sole 13 or rear of the club head 1. This portion of the club head 1 preferably is formed of a dense, and more preferably very dense, material. High density materials are more effective for affecting mass and other properties of the club head 1, but stock alloys may alternatively be used. Preferred materials for this portion of the club head 1 include tungsten, and a tungsten alloy, including castable tungsten alloys. The density of the third body portion 24 preferably is greater than about 7.5 g/cm$^3$, and more preferably is about 10 g/cm$^3$ or greater. The density of the third body portion 24 should be greater than the density of the first body portion 20, which in turn should be greater than the density of the second body portion 22. The third body portion 24 can be provided in a variety of forms, such as in the form of a bar or one or more weight inserts. The third body portion 24 can be formed in a variety of manners, including by powdered metallurgy, casting, and forging. An exemplary mass range for the third body portion 24 is 2-30 grams. Alternatively, the third body portion 24 may comprise 10% or more of the overall club head weight.

This multi-part design allows the removal of unneeded mass (and weight), which can be redistributed to other, more beneficial locations of the club head 1. For example, this "freed" mass can be redistributed to do one or more of the following, while maintaining the desired club head weight and swingweight: increase the overall size of the club head 1, expand the size of the club head sweet spot, reposition the club head center of gravity (COG), and/or produce a greater moment of inertia (MOI) measured about either an axis parallel to the Y-axis or Z-axis passing through the COG. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits because less energy is lost during impact from club head twisting. Moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI.

The face portion of the first body portion 20 preferably is provided as thin as possible, while still maintaining sufficient structural integrity to withstand the forces incurred during normal use of the golf club and while still providing a good feel to the golf club. The second body part 22 provides for a traditional or otherwise desired appearance without adding appreciable weight. The second body part 22 also acts as a spacer, allowing the third body part 24 to be positioned at a desired distance rearward from the face 11, which in turn repositions the COG rearward and/or lower with respect to traditional club heads. By so positioning the center of gravity, the golf club is more forgiving. The COG position may be lowered further by removing unnecessary mass from the top line 12. Preferred methods of doing so are disclosed in pending U.S. patent application Ser. Nos. 10/843,622, published as Publication No. US2005/0255938, 11/266,172, published as Publication No. US2006/0052183, and 11/266,180, published as Publication No. US2006/0052184, which are incorporated herein in their entireties.

The third body portion 24 may be positioned so that a spring-mass damping system is formed. One such location is shown by the dashed lines of FIG. 4 and indicated by reference 24'. With the face 11 acting as the vibrating body, the second body portion 22 acts as the spring, and the third body portion 24 acts as the ground.

Figure 4:
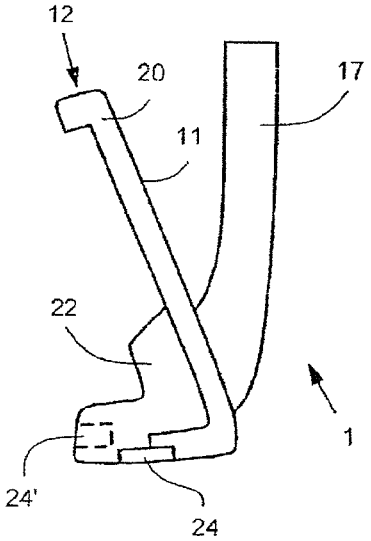
FIG. 4 is a cross-sectional view of a golf club head of the present invention.

In the illustrated embodiment of FIG. 3, the first body portion 20 includes the face 11 and the entire sole 13. The second body portion 22 is coupled to the rear surface of the first body portion 20, and extends all the way to the top line 12. The third body portion 24 is coupled to the first body portion 20 in the sole 13 of the club head 1. In this illustrated embodiment, the third body portion 24 is positioned only in the sole 13. Another embodiment is illustrated in FIG. 4. Here, the second body portion 22 extends only partially up the rear surface of the first body portion 20 and gives the club head 1 the appearance of a cavity back club head. In this embodiment, the sole 13 is formed by both the first and second body portions 20, 22, and the third body portion 24 is coupled to both the first and second body portions 20, 22.

The club head 1 may be assembled in a variety of manners. One preferred assembly method includes first forming the first and third body portions 20, 24, such as by casting or forging. These portions 20, 24 may then be placed in a mold, and then the material forming the second body part 22 inserted into the mold. Thus, the second body portion 22 is molded onto and/or around the first and third body portions 20, 24, creating the final club head shape. The second body part 22 may thus be bonded to either or both of the first and third body portions 20, 24. This is referred to as a co-molding process.

Figure 5:
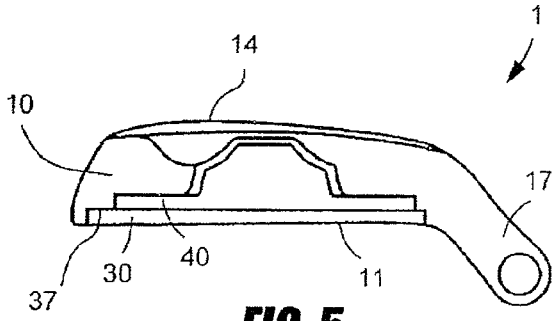
FIG. 5 is a top view of a golf club head of the present invention.

FIG. 5 is a top view of a golf club head 1 of the present invention. In this illustrated embodiment, the club head 1 includes a body 10 and a face insert 30 having a striking face 11. The body 10 defines a front opening 35, and has a ledge 37 adjacent the front opening 35. The ledge 37 may extend only partially around the perimeter of the front opening 35 or may be provided as several discrete sections, but preferably the ledge 37 extends completely around the perimeter of the face opening 35 (360°). The face insert 30 is coupled to the body 10 at the ledge 37. Preferably, the face insert 30 and the body 10 are in contact only along the ledge 37, thus minimizing the metal-to-metal contact between the two elements.

Figure 16:
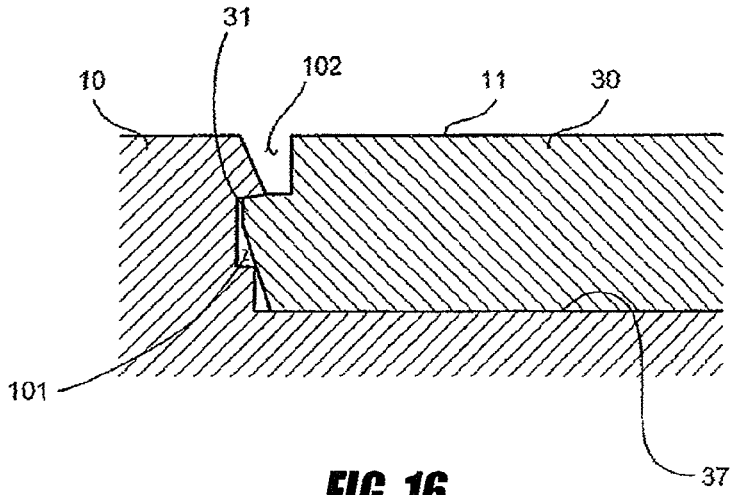
FIG. 16 is a partial cross-sectional view of a golf club head of the present invention illustrating one way of connecting a face insert to the club head body.

The face insert 30 to body 10 connection may be facilitated by the use of a groove and lock tab configuration. Such a configuration is shown in FIG. 16, which is a partial cross-sectional view of a golf club head of the present invention. The body 10 at ledge 37 defines a groove 101 therein that extends inward into the body 10. The face insert 30 includes a tab 31 corresponding to the groove 101. When the face insert 30 is inserted into the body opening 35, the tab 31 contacts the side wall of the ledge 37. When enough force is exerted, either or both of the tab 31 and the upper portion of the ledge 37 side wall deform, preferably elastically deform, allowing the face insert 30 to be inserted to its designed final position (such as being seated at ledge 37). When in this final position, the tab 31 passes the upper ledge wall portion and snaps out into place within the groove 101. Because the upper ledge wall portion now extends over the insert tab 31, the face insert 30 is retained in position. This tab-groove retention scheme could be provided around the entire perimeter of the face insert 30, or more preferably may be positioned in discrete locations around the insert perimeter. It is possible that instead of the tab 31 being part of the face insert 30 and the groove being defined by the body 10, the opposite construction, wherein the body 10 contains a tab and the face insert 30 contains a corresponding groove, may also be used. Furthermore, these varying constructions could both be employed on a single club head 1.

Figure 17:
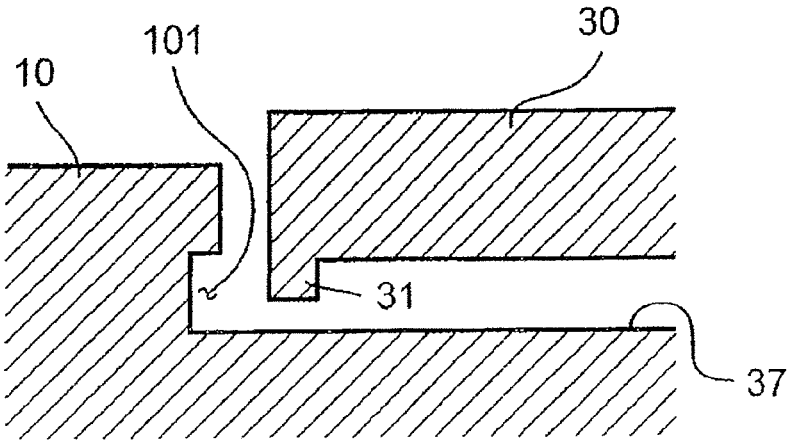
FIG. 17 is a partial cross-sectional view of a golf club head of the present invention illustrating another way of connecting a face insert to the club head body.

FIG. 17 illustrates an alternate groove and lock tab configuration. In this illustrated embodiment, in which the face insert 30 has not yet been coupled to the club head body 10, the face insert 30 contains tabs 31 extending rearward from perimeter edges thereof. The club head body 10 contains grooves 101 extending in a direction substantially perpendicular to the ledge 37, such as toward the heel 15 and toe 16. When the face insert 30 is coupled to the club head body 10, tabs 31 are plastically deformed into the corresponding grooves, locking the face insert 30 to the body 10.

An adhesive or other joining agent may be used to further ensure that the face insert 30 is retained as intended. The face insert 30 and/or upper ledge wall portion may be designed to define a groove 102 around the face insert 30 to provide a run-off or collection volume for any excess adhesive. This not only provides a pleasing aesthetic appearance in the finished golf club, but also beneficially reduces assembly and manufacturing time. Exemplary ways of creating the groove 102 include by angling the upper portion of the ledge side wall and/or by stepping-in the outer portion of the face insert 30.

Figure 13:
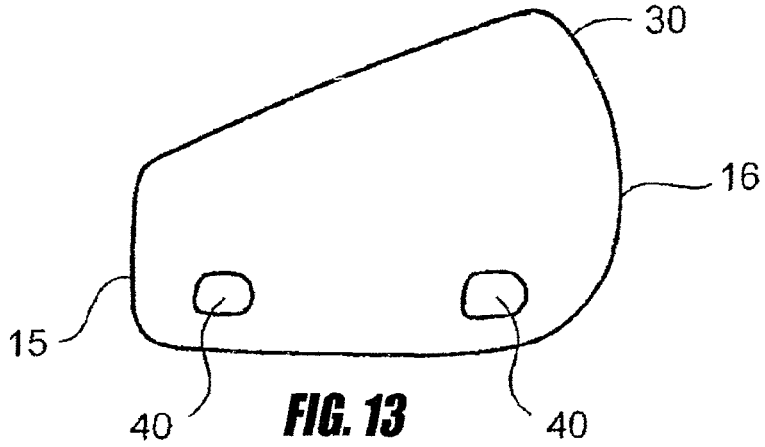
FIG. 13 is a rear view of a face insert with dampers positioned to contact its rear surface at heel and toe portions thereof.
Figure 14:
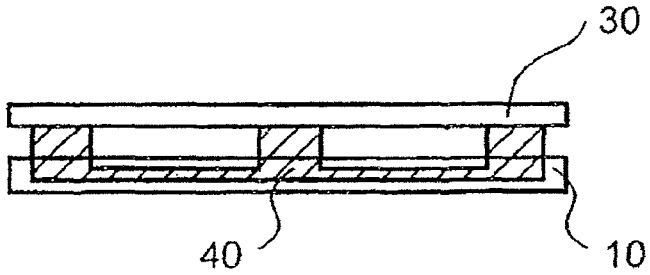
FIG. 14 is a cross-sectional top view of a damping member having a plurality of fingers extending outward to contact the rear surface of the face at heel, toe, and central portions thereof.

A damping member 40 is positioned intermediate the body 10 and the face insert 30. As the face 30 deflects during use, the deflection forces are imparted to the damping member 40, which dissipates such forces and reduces the resulting vibration. This lessens and may eliminate vibrations—such as those incurred during an off-center hit—being transmitted through the club head and shaft to the golfer, resulting in a club with better feel and a more enjoyable experience to the golfer. Preferably, the damping member 40 is held in compression between the body 10 and the face 30, which enhances the effectiveness of the vibration damping aspects of the damping insert 40. Preferably, the damping member 40 is positioned such that it is in contact with a rear surface of the face insert 30 opposite the club head sweet spot. The damping member 40 may contact the rear surface of the face insert 30 at other locations, such as the heel 15 or toe 16 or top line 12, in addition to or instead of at the sweet spot. FIG. 13 illustrates a rear view of a face insert 30 with dampers 40 positioned to contact the rear surface of the face 30 at heel 15 and toe 16 portions thereof. FIG. 14 illustrates a cross-sectional top view of a damping member 40 having a plurality of fingers extending outward to contact the rear surface of the face 30 at heel 15, toe 16, and central portions thereof. It should be noted that while the entire damping member 40 is shown in FIG. 14, a portion of it would actually be blocked from view by the body 10. Depending upon the vertical placement of the damping member 40, the central finger may be in contact with the face insert 30 opposite the club head sweet spot. Recesses, indentations, or the like may be provided in the rear surface of the face insert 30 to position and help retain the damping members 40 in place. It is beneficial to provide a damping member 40 at these locations because impacts (such as with a golf ball) in these areas create more vibration than center impacts by virtue of the impact being farther from the club head center of percussion. As shown for example in FIG. 14, there may be a gap, such as due to an undercut, making the damping member 40 visible in the finished club head. Thus, the damping member(s) 40 may be "free floating" with no portion of the member(s) 40 in contact with the face 30 being constrained against expansion due to compression. In other words, no portion of the club head body 10 is in contact with the damping member(s) 40 at its distal end adjacent to and abutting the face 30; the damping member(s) 40 is open 360° to the environment at its distal end. This may enhance their vibration damping effect. As further shown in FIG. 14, the damping member(s) 40 may take the form of a plurality of fingers of suspended, compressed damping material contacting the rear surface of the face 30.

Figure 6:
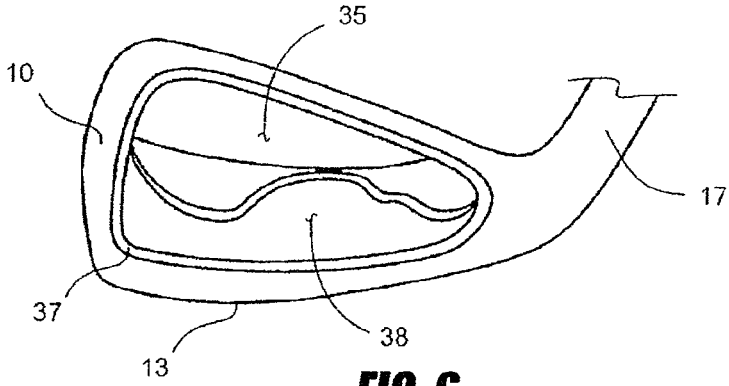
FIG. 6 is a front view of the body member of the golf club head of FIG. 5.

FIG. 6 is a front view of the body 10 of the golf club head 1 of FIG. 5 without the face insert 30 or damping member 40 in place. Through the front opening 35, it can be seen that the body 10 preferably includes an undercut 38. Inclusion of the undercut 38 removes additional material from the club head body 10, further enhancing the weight distribution, COG location, MOI, and other benefits discussed above. The undercut can extend 360° around the face perimeter, or can extend to any desired fraction thereof, such as 90° or less. In the illustrated embodiment of FIG. 6, the undercut 38 extends from a mid-heel area to a mid-toe area. The undercut preferably extends toward the sole 13 in a lower portion of the body 10. Preferably, the damping member 40 is positioned to at least partially fill the undercut 38.

In one preferred embodiment, the COG is located 17.5 mm or less above the sole 13. Such a COG location is beneficial because a lower COG facilitates getting the golf ball airborne upon being struck during a golf swing. Also, the MOI measured about a vertical axis passing through the club head COG when grounded at the address position is preferably 2750 $g \cdot cm^2$ or greater. This measurement reflects a stable, forgiving club head.

These attributes may be related conveniently through the expression of a ratio. Thus, using these measurements, the golf club head has a MOI-to-COG ratio of approximately 1600 g·cm or greater. As used herein, "MOI-to-COG ratio" refers to the MOI about a vertical axis passing the club head COG when grounded at the address position divided by the COG distance above the sole 13.

In certain clubs, it may be desirable to raise the center of gravity. For example, clubs with a high loft angle such short irons (9 iron-wedges) may benefit from a higher center of gravity than other clubs in a set. Without being bound to any particular theory, a club with a high center of gravity is likely to impart more spin to the golf ball due to vertical gear effects. This is because an impact made below the center of gravity will increase the spin rate of the ball to help maximize trajectory and distance. The ability to generate more ball spin for the short irons is an important factor in the golfer's ability to control both the distance of the golf shot, and the distance the ball will roll after the ball hits the green. For example, a short iron or wedge may have a vertical center of gravity $CG_Z$ that is greater than about 17 mm. Preferably, a short iron has a vertical center of gravity $CG_Z$ that is greater than about 18 mm. In one embodiment, a short iron has a vertical center of gravity $CG_Z$ that is greater than about 20 mm.

Without being bound to any particular theory, adding mass to the top line raises the center of gravity and the moment of inertia of the club head. In one embodiment, mass is added to the top line in the form of one or more high density inserts. Suitable materials for the high density insert include, but are not limited to, powdered tungsten, a tungsten loaded polymer, and other powdered metal polymer combinations.

According to another aspect of the invention, the center of gravity may be raised for certain clubs in a set by reducing the size of the third body portion, which is located near the sole. In one embodiment, the third body portion comprises greater than about 10% of the overall mass of the club head. In order to achieve a golf club head with a higher center of gravity, the weight members may be reduced in size so that the weight members comprise less than about 10% of the total mass of the club.

In one embodiment of the invention, the third body portion 24 may be comprised of a different material for certain clubs in a set. For example, the long irons (3-6 iron) may have a third body portion 24 that is comprised of a material with a density greater than about 10 $g/cm^3$. Alternatively, the middle and short irons (7-iron through wedges) may have a third body portion 24 comprising a material with a density of less than about 10 $g/cm^3$.

In the alternative, an impact made high on the face above the center of gravity will create a higher launch angle, and the vertical gear effect will actually cause the ball to spin less. This can produce greater distance as the ball is subject to less lift or drag that a higher spin creates. As such, it may be desirable to lower the center of gravity for the lower loft angle irons (3-6). For example, a long iron may have a vertical center of gravity $CG_Z$ that is less than about 17.5 mm. In one embodiment, the center of gravity $CG_Z$ is less than about 17 mm. In another embodiment, the center of gravity $CG_Z$ is less than about 16.5 mm.

Lowering the center of gravity may be achieved by removing material from the top line, as discussed and incorporated above. Alternatively, the mass of third body portion 24 may be increased to comprise greater than about 10% of the total mass of the club head. In one embodiment, the mass of third body portion 24 comprises greater than about 15% of the total mass of the club head.

In another embodiment, the sole of the club head can be made wider in a face to back direction. A wider sole will result in more mass located near the sole, which lowers the center of gravity of the club head. In the alternative, the sole of the club head may be made thinner in a face to back direction. The thinner sole results in a club head with less mass located near the sole of the club head, which raises the center of gravity of the club head.

According to one aspect of the invention, the center of gravity is altered by varying the thickness of the face or a face insert. For example, a thick face or face insert may result in a higher center of gravity. In particular, a striking face or face insert with a thicker lower portion and a thin upper portion may result in a lower center of gravity. In addition, a thin face or face insert may result in a lower center of gravity.

In one embodiment, the size of a cavity located in the back of the club head may be varied to affect the center of gravity location. For example, the cavity may remove more material from a lower portion of the club head than the upper portion of the club head, which results in a higher center of gravity. Alternatively, the cavity may remove more material from the upper portion of the club head, which results in a lower center of gravity.

In another embodiment, the height of the club head may be increased or decreased to alter the center of gravity of the club head. For example, increasing the height of the club head adds material to the club head, which raises the center of gravity. Likewise, lowering the height of the club head will remove material from the top of the club thereby lowering the center of gravity.

Any of the methods described above may be combined to further manipulate the location of the vertical center of gravity.

As previously described, the golf club head of the present invention has a moment of inertia $I_{ZZ}$ about an axis that passes through the center of gravity and is parallel to the z-axis (as shown in FIG. 2). This axis of rotation relates to the forgiveness of an iron in the heel to toe rotation about the center of gravity. Thus, a higher $I_{ZZ}$ indicates a greater resistance to twisting on off-center hits, resulting in more forgiveness. Regardless of the location of the vertical center of gravity, the $I_{ZZ}$ for the present invention is preferably greater than about 2800 g·cm$^2$. In one embodiment the moment of inertia $I_{ZZ}$ for the present invention is preferably greater than about 2900 g·cm$^2$. In one embodiment, the moment of inertia $I_{ZZ}$ is greater than 3000 g·cm$^2$.

In addition, the moment of inertia $I_{ZZ}$ for a club head of the present invention may be related to the vertical center of gravity ($CG_Z$) by the following equation:

$$I_Z \geq CG_Z * 170 \quad (1)$$

where $I_{ZZ}$ is in g·cm$^2$ and $CG_Z$ is measured in millimeters (mm) in the z-direction.

In one embodiment, the club head satisfies the following relationship between the density of the second body portion the moment of inertia $I_{ZZ}$, and the center of gravity $CG_Z$:

$$I_{ZZ} \geq CG_Z * D * 123 \quad (2)$$

where D is the density of the second body portion in g/cm$^3$, $I_{ZZ}$ is greater than 2800 and is in g·cm$^2$, and $CG_Z$ is measured in millimeters (mm) in the z-direction.

In another embodiment, the club head satisfies the following relationship between the density of the third body portion, the moment of inertia $I_{ZZ}$, and the center of gravity $CG_Z$:

$$I_{ZZ} \geq CG_Z * D * 17 \quad (3)$$

where D is the density of the third body portion in g/cm$^3$, $I_{ZZ}$ is greater than 2800 and is in g·cm$^2$, and $CG_Z$ is measured in millimeters (mm) in the z-direction.

According to one aspect of the invention, the club head that satisfies any of equations 1-3 above has a loft angle of between about 25° to about 32°.

A set of club heads including at least one club head with a low center of gravity and at least one club head with a higher center of gravity will preferably have clubs in the set that meet the relationship of all three equations. For example, a set of clubs may include at least one club head with a vertical center of gravity that is greater than about 17 mm. Preferably, at least one club head in the set has a center of gravity that is greater than about 18 mm. In one embodiment, at least one club head in the set has a vertical center of gravity $CG_Z$ that is greater than about 20 mm. In addition, at least one club head in the set has a vertical center of gravity $CG_Z$ that is less than about 17 mm. In another embodiment, at least one club has a center of gravity $CG_Z$ that is less than about 16.5 mm. Preferably, all of the clubs in the set have a moment of inertia $I_{ZZ}$ that is preferably greater than about 2800 g·cm$^2$. In addition, at least one club in the set preferably has an moment of inertia $I_{ZZ}$ greater than 3000 g·cm$^2$.

Preferred materials for the body 10 and the face insert 30 are discussed above with respect to the first body portion 20, and preferred materials for the damping member 40 are discussed above with respect to second body part 22. Additionally, when a face insert is used, it preferably may comprise a high strength steel or a metal matrix composite material, a high strength aluminum, or titanium. A high strength steel typically means steels other than mild low-carbon steels. A metal matrix composite (MMC) material is a type of composite material with at least two constituent parts, one being a metal. The other material may be a different metal or another material, such as a ceramic or organic compound. These materials have high strength-to-weight ratios that allow the face insert 30 to be lighter than a standard face, further freeing mass to be beneficially repositioned on the club head 1 and further enhancing the playability of the resulting golf club. It should be noted that when a face insert is used, material selection is not limited by such constraints as a requirement for malleability (such as is often the case when choosing materials for the body and hosel). If a dissimilar material with respect to the body 10 is chosen for the face insert 30 such that welding is not a readily available coupling method, brazing, explosion welding, and/or crimping may be used to couple the face insert 30 to the body 10.

The face insert 30 may be formed of titanium or a titanium alloy. This face insert 30 may be used in conjunction with a stainless steel body 10, an exemplary stainless steel being 17-4. As these two materials are not readily joined by welding, crimping is a preferred joining method. This typically includes formation of a raised edge along all or portions of the face opening perimeter, which is mechanically deformed after the placement of face insert, locking the two together. The face insert may be beveled or otherwise formed to facilitate crimping. One or more machining/polishing steps may be performed to ensure that the strike face is smooth. Alternatively, the face insert 30 may be formed of a stainless steel, which allows the face insert 30 and the body 10 to be readily joined via welding. One preferred material is 1770 stainless steel alloy. As this face insert material is more dense than titanium or titanium alloy, the resulting face insert 30-body 10 combination has an increased weight. This may be addressed by increasing the size (i.e., the volume) of the undercut 38, such that the overall size and weight of the club heads are the same.

This embodiment of the club head 1 may be assembled in a variety of manners. One preferred method of assembly includes casting, forging, or otherwise forming the body 10 and the face insert 30 (in separate processes). The face insert 30 may be formed such that it has one or more raised areas 32 on a rear surface thereof. (See FIG. 7, which is a side view of the golf club head 1 of FIG. 5 when cut (substantially) in half approximately through a vertical centerline of the club head 1.) These raised areas 32 are in at least partial contact with the damping member 40 when the club head 1 is assembled, and act as guide walls to help orient the damping member 40 into the desired proper position. The damping member 40 may be molded with the body 10 and face insert 30 in place as discussed above. Alternatively, the damping member is positioned in the desired location within the body 10 before the face insert 30 is coupled to the ledge 37 or the damping member 40 is put into place after the face 30 is attached to the body 10. Preferably, the damping member 40 is larger than the resulting volume of its location in the assembled club head 1. Thus, when the face insert 30 is positioned along the ledge 37 within the face opening 35, the damping member 40 is compressed, and is retained in a state of compression in the assembled club head 1 to further enhance vibration dissipation.

Figure 8A:
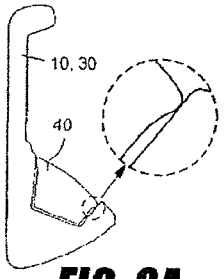
FIGS. 8A, 8B, and 8C illustrate additional methods of connection the damping member to the club face and/or body of the club head of FIG. 5.
Figure 8B:
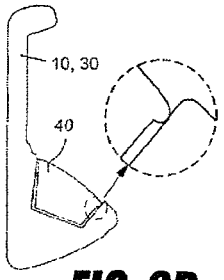
Figure 8C:
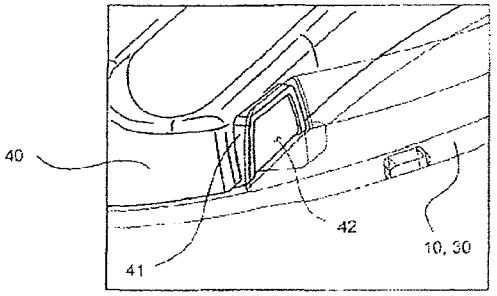

FIGS. 8A, 8B, and 8C illustrate additional methods of connecting the damping member 40 to the club face 30 and/or body 10. In the illustrated embodiments of FIGS. 8A and 8B, the damping member 40 flairs outward at its upper end. This increases the frictional forces between it and the face 30 and/or the body 10, substantially locking the damping member 40 in place. It should be noted that the spaces or empty volumes shown in FIGS. 8A and 8B are provided for purposes of illustration and may likely not be present in the assembled club head 1. In the illustrated embodiment of FIG. 8C, the damping member 40 is provided with a projection 41 and the face insert 30 and/or body 10 is provided with a corresponding chamber 42 into which the projection 41 is retained, substantially locking the damping member 40 in place. While only one projection 41 and corresponding chamber 42 are shown, two or more such projections-chambers 41, 42 can be used.

The damping member 40 may comprises a plurality of materials. For example, the damping member 40 may include a first material in contact with the face insert 30 and a second material in contact with the body 10. The materials of the damping member may have varying physical characteristics, such as the first material (adjacent the face insert 30) being harder than the second material (adjacent the body 10). The differing materials may be provided in layer form, with the layers joined together in known fashion, such as through use of an adhesive or bonding.

The damping member 40 may comprise a material that changes appearance when subjected to a predetermined load. This would provide the golfer with visual confirmation of the damping at work.

Figure 7:
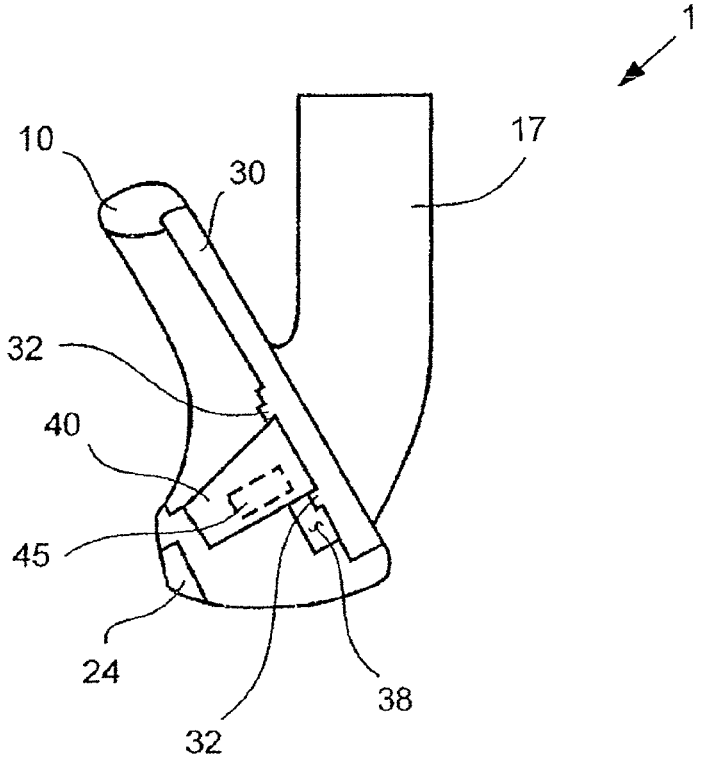
FIG. 7 is a side view of the golf club head of FIG. 5 when cut in half.

As shown in FIG. 7, the club head 1 may include a weight member 24, which is discussed above in terms of the third body portion 24. The weight member 24 may be cast or forged in place during formation of the body 10, or may it may be added after the body 10 has been formed, such as by welding or swaging it in place. As shown by the dashed lines in FIG. 7, the damping member 40 may be provided with one or more weight members 45 having similar properties to the weight member 24. The weight member(s) 45 may be encapsulated within the damping member 40. An exemplary mass range for both weight members 24, 45 is 2-30 grams. Alternatively, the weight members 24, 45 may comprise 10% or more of the overall club head weight, individually or collectively. Upon contact with a golf ball, the encapsulated weight 45 exerts a force on the material of the damping member 40, causing it to deform. This deformation further dissipates vibrations generated during use of the golf club. Preferably, the damping member 40, with or without inclusion of the weight member 45, is positioned between the body 10 and the face insert 30 such that the loading on it will be consistent, regardless of the golf ball impact location on the striking face 11.

Figure 9:
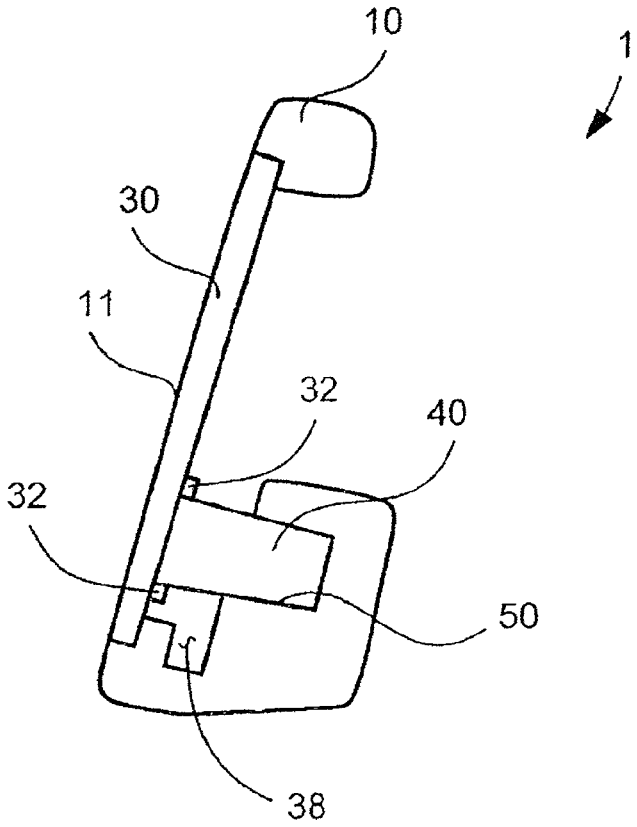
FIG. 9 is a cross-sectional view through a golf club head of the present invention.

FIG. 9 is a cross-sectional view through a golf club head 1 of the present invention. In this illustrated embodiment, guides 32 hold the damping member 40 in place adjacent the rear surface of the face insert 30, and the rear portion of the body 10 includes a chamber 50 into which the rear portion of the damping member 40 is positioned. In this manner, it is not necessary to couple the damping member 40 to the face insert 30 or the body 10. Inclusion of the guides 32 is optional, as the damping member 40 may be retained in the desired position by the chamber 50 alone. Additionally, the contacts between the damping member 40 and the body 10 and/or the face insert 30 can be lubricated so that frictional forces are minimized. If a weight member is used within or adjacent to the damping member 40 (an example of the latter being inclusion of a separate weight member adjacent a rear surface of the damping member 40 or a separate weight member intermediate layers of damping material), the contacts between the weight member and the damping member 40 can also be lubricated to further reduce frictional forces.

Figure 10:
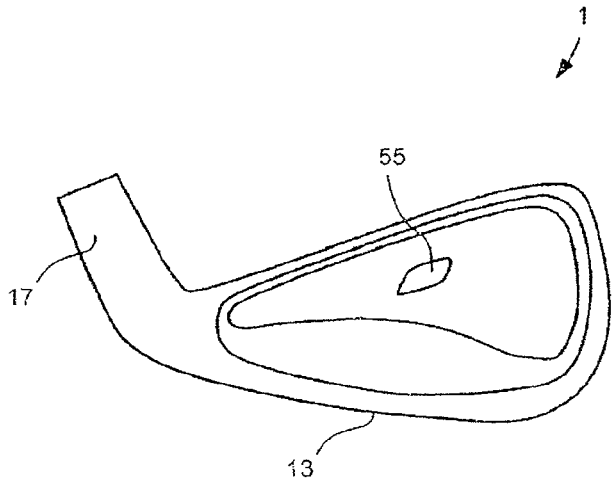
FIG. 10 is a rear view of a golf club head of the present invention.

FIG. 10 is a rear view of a golf club head 1 of the present invention. The rear surface of the face includes a projection 55 extending outward from a rear surface thereof. In the illustrated embodiment, the club head 1 is a cavity back and the projection 55 is located within the cavity, such that it is visible in the assembled club head 1. Preferably, the projection 55 has the shape of a rhombus. The benefits of including the projection 55 are discussed in U.S. Pat. No. 7,029,403 and U.S. Patent Application Publication Nos. 2006/0068932, 2005/0192118, 2005/0187034, 2005/0009634, 2005/0009633, and 2003/0195058, each of which is incorporated herein by reference. The rear surface of the face preferably may be machined to form the projection 55 and/or other features.

As discussed above, incorporating a face plate 30 formed of a relatively lightweight material provides certain benefits to the resulting golf club. Aluminum (including aluminum alloys) is one such lightweight material. M-9, a scandium 7000-series alloy, is one preferred aluminum alloy. Using a face insert 30 that comprises aluminum with a steel body 10, however, can lead to galvanic corrosion and, ultimately, catastrophic failure of the golf club. To realize the benefits both of using a face insert 30 comprising aluminum and a body 10 comprising steel (such as a stainless steel), without being susceptible to galvanic corrosion, a layered face insert 30 may be used.

Figure 11:
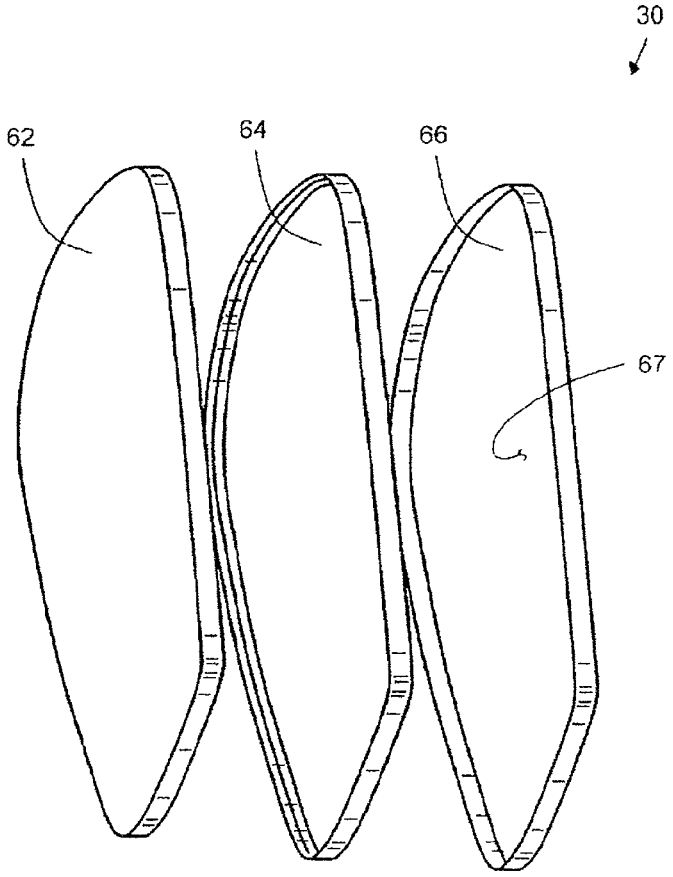
FIG. 11 is a perspective view of a layered face insert of the present invention.

FIG. 11 illustrates such a layered face insert 30. There are three main components to this layered face insert 30. A first layer 62 is provided, and preferably is formed of a high strength, lightweight metallic (preferably an aluminum alloy) or ceramic material. This first layer 62 includes a surface that functions as the strike face 11. (While no grooves 18 are shown in the illustrated embodiment of FIG. 11 for the sake of clarity, it should be recognized that grooves of varying design can be included.) The first layer 62 is lighter than typical face inserts for the beneficial reasons discussed above.

Figure 12:
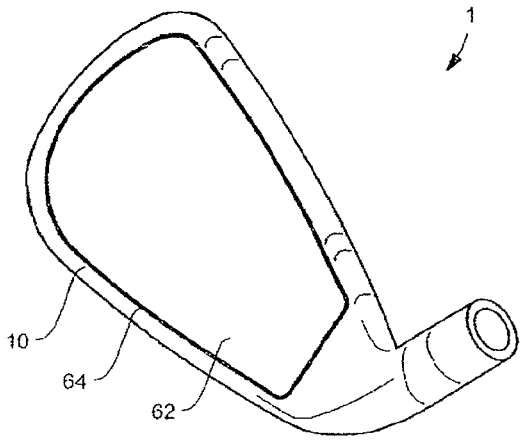
FIG. 12 is a front view of a golf club head of the present invention employing the layered face insert of FIG. 11.

A second layer 64 is provided to the rear of and abutting the first layer 62. This layer 64 is formed of a lightweight material, such as those discussed above with respect to the second body part 22. This layer 64 provides the desired sizing and damping characteristics as discussed above. The first and second layers 62, 64 may be joined together, such as via bonding. This second layer 64 may contain a lip extending outward around its perimeter, thus forming a cavity, into which the first layer 62 may be retained. In this manner, the metallic material of the first layer 62 may be isolated from the material of the club head body 10, and galvanic electrical flow between the club head body 10 and the metallic portion(s) of the face insert 30 is prevented. The third main component of the layered face insert 30 is a foil 66. The foil 66 is very thin and may be formed of a variety or materials, including materials that act to prevent galvanic corrosion. The foil 66 includes a pocket or cavity 67 sized to envelop the first and second layers 62, 64. The foil 66 may be joined to the first and second layer 62, 64 combination via an adhesive or other means, or simply by being pressed or otherwise compressed against the rear and perimeter surfaces of the second layer 64. The layered face insert is then joined to the club head body 10 in known manner, such as by bonding and/or crimping. FIG. 12 shows a front view of a golf club head 1 employing the layered face insert 30. Inclusion of the foil 66 is optional.

Other means for preventing galvanic corrosion may also be used. These may include coating the face insert 30 or the corresponding structure of the body 10, such as ledge 37. Preferred coating methods include anodizing, hard anodizing, ion plating, and nickel plating. These alternate corrosion prevention means may be used in conjunction with or alternatively to the three-part face insert construction described herein.

The rear surface of the second layer 64 may be provided with a contoured surface. One such surface being, for example, a logo or other manufacturer indicium. In certain embodiments, the rear surface of the face insert 30 is visible. As the foil layer 66 is very thin and mated to the rear surface of the second layer 64, the textured rear surface of the second layer 64 is visible in these embodiments. The foil 66 may be colored or otherwise decorated to enhance the visibility of the logo, indicium, or other texture of the second layer 64. If the foil 66 is colored or otherwise decorated prior to be joined to the layers 62, 64, the textured surface can be colored and otherwise enhanced without costly and time consuming processes, such as paint filling, that are typically required. A plurality of indicia, examples including manufacturer and product line identifiers, preferably may be included in this manner.

Figure 15:
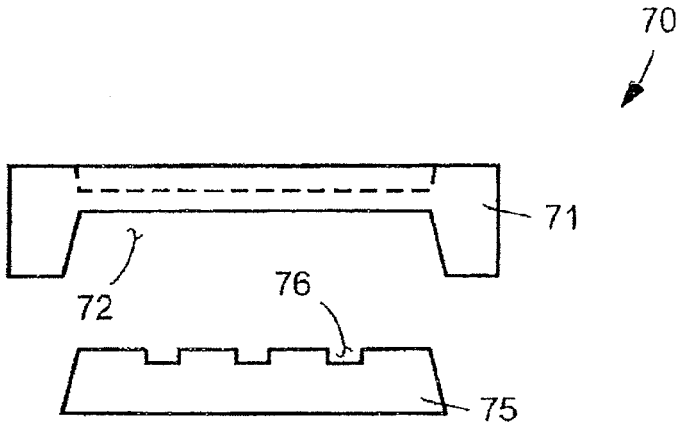
FIG. 15 is an exploded side view of a multi-part medallion of the present invention.

Alternatively or in addition to using a contoured rear second layer surface and the foil 66 to provide indicia, a medallion may be used. An exploded side view of a preferred medallion 70 is shown in FIG. 15. This medallion 70 includes a base member 71 formed of a resilient material, such as those discussed above with respect to the damping members 40 and the second body part 22. Either of these previously discussed components may have the additional function of serving as the base member 71. The medallion 70 further includes an indicia member 75, which may be formed from a variety of materials, such as a low density polycarbonate resin, a low density metallic material, or acrylonitrile butadiene styrene (ABS). The main requirement for the indicia member 75 material is that it exhibit some amount of rigidity so that the indicia is not distorted. The indicia member 75 may be hollow. The indicia member 75 includes a top surface that may contain one or more grooves 76. These grooves 76 may be used to form the indicia, and they may be paint-filled. The indicia member 75—including the grooves 76, if present—can be formed in a variety of manners. One preferred manner is electroforming, which is a readily repeatable, high-tolerance process that results in a part with a high surface finish. This process is readily used with complex configurations, and the resulting part is not subject to shrinkage and distortion associated with other forming techniques.

Figure 18:
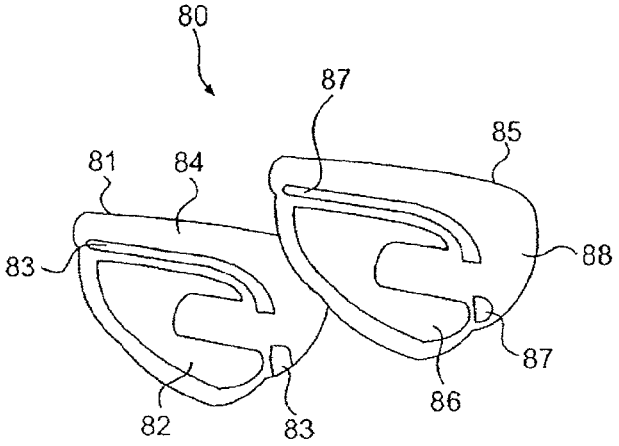
FIG. 18 shows an exploded view of an insert assembly for use with a golf club head of the present invention.
Figure 19:
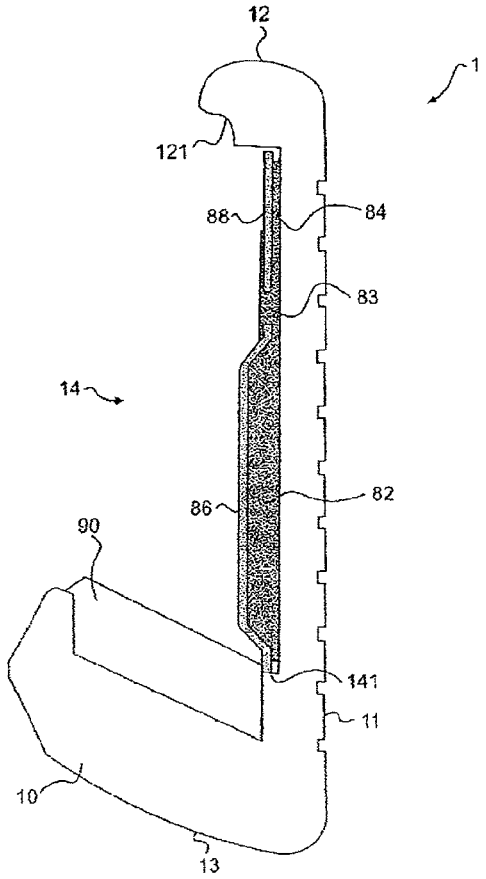
FIG. 19 shows a cross-sectional view of a golf club head of the present invention employing an insert assembly of FIG. 18.

The base member 71 defines a chamber 72 into which the indicia member 75 is positioned and retained. Adhesive, epoxy, and the like may be used to join the base member 71 and the indicia member 75. Corresponding walls of the chamber 72 and the indicia member 75 may be sloped to lock the indicia member 75 in place within the chamber 72. As indicated by the dashed lines in FIG. 15, the base member 71 contains an opening through which the indicia member 75—including the paint-filled grooves 76, if present—can be viewed. The indicia member 75 may extend through the opening such that its upper surface is flush with the base member upper surface. Alternatively, the indicia member 75 does not extend completely to the base member upper surface; rather, there may be a void between the upper surfaces of the base member 71 and the indicia member 75. This void can be left empty, or it may be filled with a clear material, such as a transparent polycarbonate, which will act to protect the indicia. A multi-piece and multi-material insert assembly may be included on the rear surface of the front wall, opposite the striking face 11. FIG. 18 shows an exploded view of such an insert assembly 80, and FIG. 19 shows a cross-sectional view of a golf club head 1 employing such an insert assembly 80. The insert assembly 80 includes two major portions. A first insert 81 of the assembly 80 has varying thickness, and is coupled to the rear surface of the front wall. A second insert 85 of the assembly 80 is placed over the first insert 81 and has a substantially constant thickness, but is contoured to correspond to the varying thickness of the first insert 81.

The first insert 81 is formed of a viscoelastic material, such as polyurethane, to damp vibrations generated during use of the resulting golf club, such as those resulting when a golf ball is struck at a location other than the sweet spot or center of percussion. The first insert 81 has varying thickness, and three regions of different thickness are shown in the illustrated embodiment. The first insert 81 may cover substantially all of the rear surface or only select portions thereof. A first region 82 has the greatest thickness and preferably constitutes a major portion of the insert 81. That is, the first region 82 preferably is the largest of the regions of the first insert 81. When coupled to the club head 1, this first region 82 is positioned low on the rear surface towards the sole wall, and thus is positioned opposite that portion of the striking face 11 that forms the intended hitting region of the club head 1. That is, the portion of the striking face 11 that is intended to contact the golf ball during a golf swing. Thus, the hitting region includes the sweet spot of the club head and a zone surrounding the sweet spot. Golfers strive to contact the golf ball within the hitting region for desired golf shots with preferred trajectory, ball flight, and shot distance. The thickness of this region 82 preferably is from 0.07 to 0.09 inch, and more preferably approximately 0.08 inch. The first region 82 preferably may comprise approximately 40-75% of surface area, and in a more preferred embodiment comprises approximately 65% of the rear surface area. A second region 83 of the first insert 81 has intermediate thickness, and substantially surrounds the first region 82. Thus, the second region 83 substantially surrounds a region on the rear surface of the face wall opposite, or corresponding to, the hitting region of the striking face 11. As shown, the second region preferably extends from an upper heel area to a lower toe area of the rear surface, arcing or curving across the rear surface. The thickness of this region 83 preferably is from 0.03 to 0.05 inch, and more preferably approximately 0.04 inch. The second region thickness preferably is also approximately half the thickness of the first region 82, meaning within ±0.005 inch or within normal manufacturing tolerances. Alternatively, the thickness of the first region 82 is at least two times that of the second region 83, and may be from two to four times the thickness of the second region 83. The second region 83 preferably may comprise approximately 10-25% of surface area, and in a more preferred embodiment comprises approximately 15% of the rear surface area. A third region 84 of the first insert 81 has the least thickness and, when coupled to the club head 1, is positioned high on the rear surface, extending towards the top line 12. In the illustrated embodiment, the second region 83 is spaced slightly from the first region 82 by a thin portion of the third region 84. The transitions between the various regions 82, 83, 84 may be stepped or gradual, such as being linearly sloped or curved. The thickness of the third region 84 preferably is from 0.01 to 0.03 inch, and more preferably approximately 0.02 inch. The third region thickness preferably is also approximately half the thickness of the second region 83, meaning within ±0.005 inch or within normal manufacturing tolerances. Alternatively, the thickness of the second region 83 is at least two times that of the third region 84, and may be from two to four times the thickness of the third region 84. The third region 84 preferably may comprise approximately 5-25% of surface area, and in a more preferred embodiment comprises approximately 20% of the rear surface area.

The second insert 85 similarly contains regions corresponding to the various regions of the first insert 81. This second insert 85 is formed of a material that is more rigid than the first insert material, examples including a metallic material such as aluminum or an aluminum alloy. Plastic is another exemplary second insert material. A first region 86 of the second insert 85 corresponds to the first region 82 of the first insert 81. The second insert 85 further contains a third region 88 corresponding to the third region 84 of the first insert 81. Additionally, the second insert 85 includes a second region 87 in the form of windows or apertures that corresponds to the second region 83 of the first insert 81. These windows 87 are openings that pass completely through the second insert 85, allowing the viscoelastic material of the first insert 81 to extend through the second insert 85 to the cavity of the club head 1 (assuming here that a cavity back club head is used). Thus, when assembled in the club head 1, the insert assembly 80 forms both a constrained-layer damper where the second insert 85 overlies the first insert 81 and a free-layer damper where the first insert second region 83 extends through the second insert layer 85. Preferably, the transitions between the various regions 86, 87, 88 match the corresponding transitions of the first insert 81. A thin portion of the second insert 85, preferably within region 88, may span the windows 87 to ensure structural integrity of the second insert 85 is maintained. Preferably, the outer surface of the first insert second region 83 is flush with the outer surface of the second insert third region 88. The outer surface of the second insert 85, such as at regions 86 and 88, may preferably by used for graphics, such as logos designating the club manufacturer and/or model.

The cross-sectional view of FIG. 19 is substantially vertical (that is, in the heel-to-top line direction) and through a central portion of the club head 1, and illustrates the varying thickness of the insert assembly 80. As shown, a ridge 141 may be formed in the lower portion of the rear wall surface adjacent the sole wall, extending rearward therefrom, upon which the rear insert assembly 80 may rest. The inserts 81, 85 may be coupled to the club head 1 in a variety of manners. One such manner includes first coupling the first insert 81 to the rear surface, for example by using an adhesive such as double-sided tape, and then coupling the second insert 85 to the first insert 81 and/or the club head body 10, such as by using an adhesive.

Another manner of connecting the insert assembly 80 to the club head 1 includes first coupling the insert portions 81, 85 together, such as by using an adhesive, and then coupling the assembled insert 80 to the rear surface of the club head 1, such as by using an epoxy. Another preferred way to couple the inserts 81, 85 is by co-molding the viscoelastic material of the first insert 81 to the second insert 85. That is, the second insert 85 may be formed first and then utilized to form at least part of a mold used to create the first insert 81. This allows for extremely tight tolerance control between the inserts 81, 85, helping ensure a desirable solid feel to the resulting golf club.

The top line 12 of the club head 1 illustrated in FIG. 19 defines a notch or groove 121 therein, preferably extending along a majority of the top line 12 from the heel to the toe. The notch 121 of the illustrated example is shown to be in a lower, rear portion of the top line 12. Inclusion of the notch 121 removes relatively heavy material from the uppermost portion of the club head 1, inherently lowering the club head COG. The mass and weight saved through provision of the notch 121 may also be added to more beneficial locations within the club head to, for example, increase the overall size of the club head 1, expand the size of the club head sweet spot, reposition the club head COG, and/or produce a greater MOI measured about either an axis parallel to the Y-axis or Z-axis passing through the COG. This top line notch may be used in conjunction with or as an alternative to the top line insert, discussed and incorporated herein above.

As discussed above, it may be desirable to raise or lower the center of gravity of a club head depending upon the type of club head in a set. For example, a short iron or wedge may have a vertical center of gravity $CG_Z$ that is greater than about 17 mm. Preferably, a short iron or wedge has a vertical center of gravity $CG_Z$ that is greater than about 18 mm. In one embodiment, a short iron or wedge has a vertical center of gravity $CG_Z$ that is greater than about 20 mm. In addition, a long iron may have a vertical center of gravity $CG_Z$ that is less than about 17.5 mm. In one embodiment, the center of gravity $CG_Z$ is less than about 17 mm. In another embodiment, the center of gravity $CG_Z$ is less than about 16.5 mm. Preferably, all of the clubs in a set will have an MOI greater than 2800 $g \cdot cm^2$. Additionally, all of the clubs preferably satisfy equation 1 discussed above.

As also shown in FIG. 19, the club head 1 further includes an insert 90 positioned within a recess in the sole wall, substantially filling this recess that extends toward the sole 13. This insert 90 preferably may be formed of a vibration damping material, and may be a multi-piece insert including, for example, a weight member and/or a manufacturer-identifying medallion. The rear portion of the insert 90 may be dimensioned to overfill the sole wall recess to beneficially ensure there are no gaps between the insert 90 and the club head body 10 after assembly. Such gaps may result from tolerances, and may eventually result in the insert 90 becoming dislodged from the club head 1. The insert 90, as shown, may also abut the lower portion of the rear surface insert 80, further ensuring its fixed retention to the club head 1.

The sole wall insert 90, as well as other medallions and inserts discussed herein, may have multiple components and may be provided in a variety of forms. One such form includes providing a first component formed of a relatively hard material, examples including ABS and polycarbonate (PC), and a second component formed of a relatively soft material, such as polyurethane or another viscoelastic material. The second component provides damping to alleviate unwanted vibration. Providing a relatively hard or rigid material (that is, the first assembly component) within the damping material of the second component may enhance the vibration damping characteristics of the insert assembly. The first component may contain an indicia, such as a manufacturer or model designation. Preferably, the second component is co-molded around the first component, with the first component comprising a portion of the upper surface of the insert/medallion assembly. The components may alternatively be joined together in other manners, such as by interference fit or through the use of an adhesive. The assembled insert may then be subject to a finishing process. One such process is chrome plating, and is appropriate for use with an ABS part. Once the components are assembled, they are submerged into a chrome plating solution such as hexavalent chromium or Cr(VI) compounds, which is then subjected to an electrical current. The current causes electrolytic deposition of chromium onto the ABS part but not the viscoelastic part. Another finishing process is physical vapor deposition, and is appropriate for use with a PC part. Once the components are assembled, an electrical current is imparted to the PC component. The negative voltage applied to the PC part attracts positive ions of the coating material, such as single metal nitrides including TiN, CrN and ZrN, which ions then form a film on the PC part but not the viscoelastic part. In addition to providing an aesthetically pleasing look, these finishing processes also provide the utilitarian benefit of strengthening the first component of the assembly, helping to protect it against damage that it may likely incur through normal use, storage, and transport of the resulting golf club(s). These finishing processes result in a plated plastic assembly. The insert/medallion assembly is then coupled to the club head in known manner.

Figure 20:
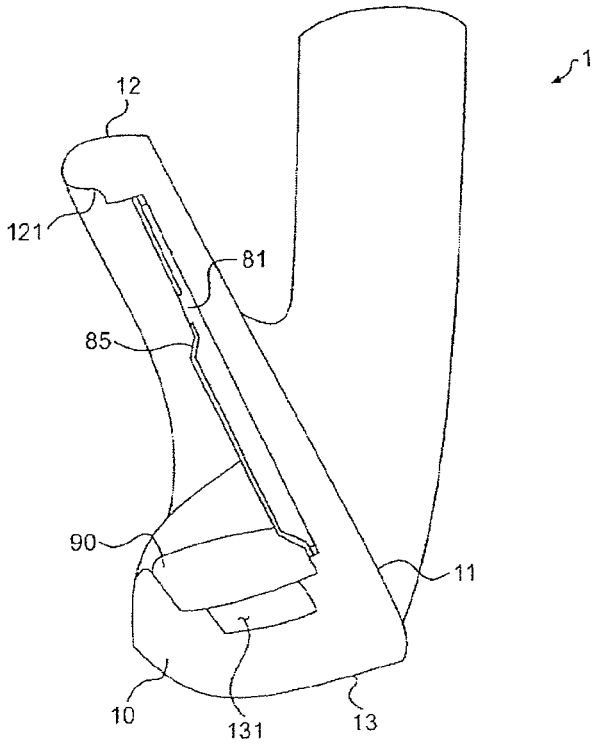
FIG. 20 shows a cross-sectional view of a golf club head of the present invention.

FIG. 20 shows a cross-sectional view of a golf club head 1 of the present invention. This club head is substantially similar to the illustrated club head of FIG. 19, but further includes a secondary recess 131 underneath the sole wall insert 90. This secondary recess 131 extends toward the sole 13 from the primary sole wall recess, in which the insert 90 is retained. Positioned in a central region of the club head 1 between the heel and toe, the secondary recess 131 removes additional mass and weight from the central portion of the club head and inherently biases mass and weight toward the perimeter of the club head 1. This secondary recess 131, which may be relatively small compared to the primary sole wall recess, may also beneficially allow the club head designer or manufacturer to discretely add weight to bring the club swingweight to a desired level. Such weight may be included in a variety of manners, such as a metallic weight member or simply just an adhesive, and may completely or partially fill the recess 131.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIGS. 1 and 2. The direction references are included to facilitate comprehension of the inventive concepts disclosed herein, and should not be read as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the inventive concepts have been discussed predominantly with respect to iron-type golf club heads, such concepts may also be applied to other club heads, such as wood-types, hybrid-types, and putter-types. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

I claim:

1. A golf club head, comprising:

a first body portion formed of a first material having a first density and including:

at least a part of a sole of the club head and forming a first part of a lower sole surface, a face portion defining a peripheral opening, and a hosel of the club head;

a face insert coupled to the peripheral opening of the first body portion and providing at least a portion of a face of the club head;

a second body portion formed of a second material with a second density lower than the first density, the second body portion having an upper part coupled to a rear surface of the first body portion opposite the face and a lower part extending backwards from the upper part and into the sole and forming a second part of the lower sole surface; and a third body portion coupled to at least one of the first and second body portions and formed of a third material having a third density greater than the first density, wherein if $I_{zz}$ is a moment of inertia about a the vertical axis and $CG_z$ is a height in mm of a center of gravity of the club head when the club head is at address, then $CG_z * 170 \leq I_{zz} >$about 2800 g·cm$^2$;

wherein the vertical center of gravity of the club head is greater than about 17 mm.

2. The golf club head of claim 1, wherein the second material has a density less than about 3 g/cm$^3$.

3. The club head of claim 1, wherein the club head is an iron-type club head.

4. A golf club head, comprising:

a first body portion including at least a part of a sole and forming a first part of a lower sole surface, a portion of a face defining an opening, and a hosel, the first body portion comprising a first material having a first density;

a face insert coupled to the opening in the first body portion and providing a central portion of the face;

a second body portion coupled to a rear surface of the first body portion opposite the face and extending down the rear surface and curving and extending into the sole and forming a second part of the lower sole surface, the second body portion comprising a second material having a second density; and a third body portion coupled to at least one of the first and second body portions, the third body portion comprising a third material having a third density;

wherein the third density is greater than the first density and the first density is greater than the second density;

wherein a rotational moment of inertia about a vertical axis is greater than about 2800 G·cm$^2$ and wherein a vertical center of gravity is less than about 17 mm;

wherein the club head satisfies the relationship:

$$I_{ZZ} \gtrsim CG_Z * D * 17$$

where $I_{zz}$ is the rotational moment of inertia about the vertical axis and has units of g·cm$^2$ and $CG_Z$ is the vertical center of gravity and has units of mm, and wherein D is the third density.

5. The golf club head of claim 4, wherein the third body portion comprises greater than about 10% of the total mass of the club head.

6. The club head of claim 4, wherein the club head is an iron-type club head.

7. A golf club head, comprising:

a first body portion including at least a part of a sole and forming a first part of a lower sole surface, a portion of a face defining an opening, and a hosel, the first body portion comprising a first material having a first density;

a face insert coupled to the opening in the first body portion and providing a central portion of the face;

a second body portion coupled to a rear surface of the first body portion opposite the face and extending down the rear surface and curving and extending into the sole and forming a second part of the lower sole surface, the second body portion comprising a second material having a second density; and a third body portion coupled to at least one of the first and second body portions, the third body portion comprising a third material having a third density;

wherein the third density is greater than the first density and the first density is greater than the second density;

wherein the density of the third material is greater than about 10 g/cm$^3$;

wherein a rotational moment of inertia about a vertical axis is greater than about 2800 g·cm$^2$ and wherein a vertical center of gravity is less than about 17 mm.

8. A golf club head, comprising:

a first body portion including at least a part of a sole and forming a first part of a lower sole surface, and a hosel;

a face insert coupled to the first body portion;

a second body portion made of a material having a density D that is less dense than a first material of the first body portion and extending along and coupled to a rear surface of the first body portion and also extending back from the rear surface into the sole and forming a second part of the lower sole surface; and a third body portion made of a third material more dense than the first material and coupled to at least one of the first and second body portions;

wherein, defining $CG_z$ as a height of a center of gravity of the club head and $I_{zz}$ as a rotational moment of inertia about a vertical axis when the club head is at address:

$$I_{ZZ} \geq CG_Z * D * 123,\ I_{zz} > \text{about } 2800\ g \cdot cm^2, \text{ and } CG_z > \text{about } 17\ mm.$$

9. The golf club head of claim 8, wherein the club head is an iron-type club head and further wherein $I_{zz}$>about 3000 g·cm$^2$.

10. The golf club head of claim 8, wherein the loft of the club head is between about 25° and about 32°.

11. A set of iron type golf clubs comprising:

at least one club of the set comprising a first club head comprising:

a first body portion including at least a part of a sole and forming a first part of a lower sole surface, and a hosel of the first club head, the first body portion comprising a first material having a first density;

a face insert coupled to the first body portion and cooperating with the first body portion to provide a face of the club head;

a second body portion coupled to a rear surface of the first body portion opposite the face and extending back from the rear surface and into the sole and forming a second part of the lower sole surface, the second body portion comprising a second material having a second density; and a third body portion coupled to at least one of the first and second body portions, the third body portion comprising a third material having a third density;

wherein the third density is greater than the first density and the first density is greater than the second density;

wherein the vertical center of gravity of the club head is greater than about 17 mm; and at least one club of the set comprising a second club head comprising:

a first body portion including at least a part of a sole and forming a first part of a lower sole surface, the first body portion comprising a first material having a first density;

a face insert coupled to the first body portion;

a second body portion coupled to a rear surface of the first body portion opposite the face and forming a second part of the lower sole surface, the second body portion comprising a second material having a second density; and a third body portion coupled to at least one of the first and second body portions, the third body portion comprising a third material having a third density;

wherein the third density is greater than the first density and the first density is greater than the second density;

wherein the vertical center of gravity of the club head is less than about 17 mm, and wherein all the clubs in the set have a rotational moment of inertia about a vertical axis is greater than about 2800 g·cm$^2$.

12. The set of golf clubs of claim 11, wherein at least one of the one club of the set satisfies the relationship:

$$I_{ZZ} \geq CG_Z * 170$$

where $I_{zz}$ is the rotational moment of inertia about a vertical axis and has units of g·cm$^2$ and $CG_z$ is the vertical center of gravity and has units of mm.

13. The set of golf clubs of claim 11, wherein at least one of the one club of the set satisfies the relationship:

$$I_{ZZ} \geq CG_Z * D * 17$$

where $I_{zz}$ is the rotational moment of inertia about a vertical axis and has units of g·cm$^2$ and $CG_z$ is the vertical center of gravity and has units of mm, and wherein D is the third density.

14. The set of golf clubs of claim 11, wherein at least one of the one club of the set satisfies the relationship:

$$I_{ZZ} \geq CG_Z * D * 123$$

where $I_{zz}$ is the rotational moment of inertia about a vertical axis and has units of g·cm$^2$ and $CG_z$ is the vertical center of gravity and has units of mm, and wherein D is the density of the second material.

15. The set of golf clubs of claim 11, wherein the face insert comprises titanium, a titanium alloy, a high strength steel, a high strength aluminum alloy, or a metal matrix composite material.

16. A golf club head, comprising:

a first body part comprising a sole portion extending into a sole area member of the club head and forming a first part of a lower-most sole surface, a face portion defining a peripheral opening, and a hosel portion defining a hosel of the club head;

a face insert coupled to the peripheral opening of the first body part to provide a face;

a low density body part coupled to a rear surface of the first body part and comprising a back portion extending down the rear surface opposite the face, a turn portion comprising a bend, and a lower portion extending into the first body part and forming a second part of the lower-most sole surface, the lower portion cooperating with the first body part to define the sole area member;

a high density body part coupled to the sole area member; and a moment of inertia about a vertical axis when the club head is at address greater than about 2800 g·cm$^2$, wherein the first body part, the low density body part, and the high density part each includes a material not found in the others.

17. The club head of claim 16, wherein the club head is an iron-type club head.

* * * * *